US007556394B2

(12) United States Patent
Patti

(10) Patent No.: US 7,556,394 B2
(45) Date of Patent: Jul. 7, 2009

(54) PAVER LIGHT

(76) Inventor: Anthony Patti, 210 S. Adelaide Ave., Highland Park, NJ (US) 08904

( * ) Notice: Subject to any disclaimer, the term of this patent is extended or adjusted under 35 U.S.C. 154(b) by 120 days.

(21) Appl. No.: 11/454,754

(22) Filed: Jun. 16, 2006

(65) Prior Publication Data

US 2006/0291197 A1 Dec. 28, 2006

Related U.S. Application Data

(63) Continuation-in-part of application No. 10/757,952, filed on Jan. 15, 2004, now Pat. No. 7,070,294.

(60) Provisional application No. 60/440,457, filed on Jan. 16, 2003.

(51) Int. Cl.
*E01F 9/00* (2006.01)

(52) U.S. Cl. ..... 362/153.1; 362/153; 404/24

(58) Field of Classification Search ..... 362/145–153.1; 404/9, 17, 22–24

See application file for complete search history.

(56) References Cited

U.S. PATENT DOCUMENTS

| | | | |
|---|---|---|---|
| 1,853,321 | A | 4/1932 | Rogers |
| 2,038,506 | A | 4/1936 | Cadieux |
| 3,007,034 | A | 10/1961 | Reed et al. |
| 3,824,524 | A | 7/1974 | Glover |
| 4,223,377 | A | 9/1980 | Williams |
| 4,382,274 | A | 5/1983 | De Backer et al. |
| 4,396,972 | A | 8/1983 | Kaneko et al. |
| 4,635,167 | A | 1/1987 | Schlosser |
| 4,697,950 | A | 10/1987 | Copeland |
| 4,744,014 | A | 5/1988 | Harris |
| 4,779,324 | A | 10/1988 | Sandor, Sr. |
| 4,851,977 | A | 7/1989 | Gary |
| 4,888,669 | A | 12/1989 | Hanson |
| 4,912,610 | A | 3/1990 | Dahlberg |
| 4,931,915 | A | 6/1990 | Quiogue |
| 4,974,134 | A | 11/1990 | Bourne |

(Continued)

OTHER PUBLICATIONS

"Product Update", Vista Professional Outdoor Lighting, 1 page, published prior to Jul. 9, 2007.

(Continued)

*Primary Examiner*—Sandra L O'Shea
*Assistant Examiner*—Jason Moon Han
(74) *Attorney, Agent, or Firm*—Greenberg Traurig, LLP

(57) ABSTRACT

A paver light having a masonry structure with an aperture and a lighting fixture positioned within the aperture of the masonry structure. The lighting fixture includes a support member with an internal cavity and a first locking member, an electrical socket removably received within the cavity of the support member, and a modular light assembly having a light source and a second locking member that is releasably enagable with the first locking member in response to the relative rotation of the first and second locking members. The modular light assembly is removably mounted to the support member by the first and second locking members, and is releasably connected to the socket such that the socket is removed from the cavity of the support member as the modular light assembly is removed from the support member. Upon removal of the modular light assembly from the support member, the modular light assembly can be disconnected from the socket for the purposes of repair or replacement externally of the masonry structure.

12 Claims, 22 Drawing Sheets

U.S. PATENT DOCUMENTS

| | | | |
|---|---|---|---|
| 4,992,914 | A | 2/1991 | Heiss et al. |
| 5,029,054 | A | 7/1991 | Trainor |
| 5,156,454 | A | 10/1992 | White |
| 5,160,202 | A | 11/1992 | Legare |
| 5,249,108 | A | 9/1993 | Gary |
| 5,335,151 | A | 8/1994 | Dahlberg |
| 5,390,090 | A | 2/1995 | Nau |
| 5,481,443 | A | 1/1996 | Wagner et al. |
| D376,657 | S | 12/1996 | Bohn |
| 5,678,920 | A | 10/1997 | Kerr |
| 5,683,170 | A | 11/1997 | Blaha |
| 5,743,622 | A | 4/1998 | Ibbitson et al. |
| 5,778,625 | A | 7/1998 | Druffel et al. |
| 5,779,349 | A | 7/1998 | Reinert, Sr. |
| 5,908,263 | A | 6/1999 | Conners et al. |
| 5,924,790 | A | 7/1999 | Ponton et al. |
| 5,943,827 | A | 8/1999 | Okerlund |
| 5,951,144 | A | 9/1999 | Gavigan et al. |
| 6,027,280 | A | 2/2000 | Conners et al. |
| 6,065,853 | A | 5/2000 | Crevier |
| 6,068,384 | A | 5/2000 | Tyson et al. |
| 6,179,435 | B1 | 1/2001 | Wilson |
| 6,231,206 | B1 | 5/2001 | Hervey et al. |
| 6,334,695 | B1 | 1/2002 | Abe et al. |
| 6,547,589 | B2 | 4/2003 | Magyar et al. |
| 6,565,239 | B2 | 5/2003 | Rizkin et al. |
| 6,578,321 | B2 | 6/2003 | Layne |
| 6,648,546 | B1 | 11/2003 | Abe et al. |
| 6,665,986 | B1 | 12/2003 | Kaplan |
| 6,796,684 | B1 | 9/2004 | Beadle |
| 6,866,032 | B2 | 3/2005 | Magyar et al. |
| 6,881,094 | B2 | 4/2005 | Magyar et al. |
| 6,976,765 | B2 | 12/2005 | Helenowski |
| 7,033,038 | B2 | 4/2006 | Hagen |
| 7,290,904 | B2 | 11/2007 | Miller |
| 2003/0048634 | A1 | 3/2003 | You et al. |
| 2003/0156405 | A1 | 8/2003 | Kim |
| 2006/0114680 | A1 | 6/2006 | Miller |
| 2007/0263396 | A1 | 11/2007 | Miller |
| 2008/0062679 | A1 | 3/2008 | Hartman |

OTHER PUBLICATIONS

Product Sheet from HUNZA Productions, Ltd., Auckland, New Zealand, 1 page (undated).

Newsletter, "Landscape Lifestyles", No. 7, © 2005, Allan Block Corporation, Edina, MN, 6 pp., viewed on Mar. 10, 2008 at <http://www.allanblock.com/RetainingWalls/Newsletter/Contractor/July05/NewsletterLayoutJly05.pdf>, (see bottom right corner of second page).

Photograph of light fixture by Integral Lighting, Wernersville, PA, bottom view (undated).

Photograph of light fixture by Integral Lighting, Wernersville, PA, top view (undated).

PAVER LIGHT

CROSS-REFERENCE TO RELATED APPLICATION

The present application is a continuation-in-part of U.S. patent application Ser. No. 10/757,952 filed on Jan. 15, 2004, now U.S. Pat. No. 7,070,294, the entire disclosure of which is expressly incorporated herein by reference, and claims the benefit of U.S. Provisional Patent Application No. 60/440,457, filed on Jan. 16, 2003.

FIELD OF THE INVENTION

The present invention relates to a light for use in interlocking concrete paving stones, commonly referred to as "pavers", and similar building components used to make driveways, walkways and patios.

BACKGROUND OF THE INVENTION

With the advent of cured concrete brick pavers, their use in home architecture, industrial architecture and landscaping has proliferated. Numerous styles and sizes of pavers and interlocking paver systems have been developed in order to enhance the functioning, as well as the aesthetics, of paver systems. Some paver systems include a method and apparatus for planning and installing pavers to achieve the maximum aesthetic effect, as well as the greatest functional value.

In providing an illuminated paver, there are special considerations that need to be addressed. One consideration relates to the strength of the paver for vehicle support. Another consideration relates to water drainage, since water and condensation may fill the inside of an electrical apparatus, thereby damaging the electrical apparatus, or presenting a shock hazard among other undesirable consequences. As a result, an illuminated paver must be strong and provide a waterproof housing or enclosure to hold the electrical components inside, thereby providing a durable, long lasting product.

Illuminated pavers have been developed previously (see, for example, U.S. Pat. Nos. 5,390,090; 5,678,920 and 6,027,280). It is noted that while the devices disclosed in the foregoing patents are designed to fit in place of a paver and provide light, none are actually masonry-based pavers. Notably, none of the pavers that are the subject of the foregoing patents has the inherent strength, color or texture of the masonry paver that it replaces.

One problem encountered with current illuminated pavers is that of vertical support. Normally vertical support is provided to each interlocking concrete brick paver from an adjacent such paver by the vertical face thickness of the adjacent paver. Typically, the vertical face of such pavers is within a range between approximately 2⅜ inches to 3 ⅛ inches or greater in height. This vertical thickness allows each paver to move slightly in a vertical direction, without significant tilting, when the paver is under load, such as when a vehicle rolls over it. This inherent feature of concrete pavers allows a load to be shared among adjacent pavers. The problem associated with other geometric-shaped non-concrete illuminated pavers occurs because the lens portion of such an illuminated paver overhangs the cast plastic body of the illuminated paver, precluding the vertical faces of other pavers from providing support to the illuminated paver.

Another type of illuminated paver includes a concrete paver with a small fiber optic light source. The fiber optics that are housed within such pavers are generally fragile and susceptible to breakage. The glass lens of the light source is also susceptible to damage by snow chains, studded tires and the like, which are on the vehicles rolling over them. A damaged fiber optic component may require substantial time and expense to effect a repair. For instance, a broken fiber optic line may require that an entire length or "run" of fiber optic line be replaced, which may further require a section of buried cable to be dug up. This procedure can be both difficult and expensive. Furthermore, the amount of light provided by such fiber optic paver lights is usually inadequate to sufficiently illuminate the paved area.

Additional issues that have arisen in relation to illuminated pavers include the power source and power consumption. High voltage, alternating current (commonly referred to as "AC") is generally avoided for outdoor applications such as paver lights because of the risk of shock due to water infiltration. Complicated grounding procedures to reduce the risk of shock are required when using AC current and as such, deter the use of AC powered illuminated pavers.

Low voltage applications for illuminated pavers, on the other hand, have been in use for some time. For example, U.S. Pat. No. 6,027,280 discloses a light powered by a 12-volt direct current (commonly referred to as "DC"). DC powered lights for pavers require only a small amount of power and, thus, there is little risk of electric shock due to water infiltration and grounding assurances are not needed.

U.S. Pat. No. 5,951,144 to Gavigan (the "Gavigan '144 Patent") discloses a low voltage lighting system that includes a brick having an upper surface and a lower surface opposite thereof, and a bore extending from the upper surface to the lower surface. The bore includes a countersunk enlargement located proximate to the upper surface of the brick. As disclosed in the Gavigan '144 Patent, the countersunk enlargement is substantially larger in shape and size than that of the remaining portion of the bore. This enables the brick to accommodate the particular structure of a modular light assembly disclosed therein. However, the problem with this configuration is that drilling and boring the countersunk enlargement and the remaining portion of the bore is difficult and time consuming, requiring careful and close attention to boring depth so as to allow the modular light assembly to sit flush with the upper surface of the brick. Moreover, if the lighting system disclosed in the Gavigan '144 Patent is to be mass produced, it would be very difficult to mold a brick with a bore having a countersunk enlargement then to simply produce a brick with an equal sized bore all the way through it. Finally, the drilling and boring of the bore having the countersunk enlargement is facilitated by a proprietary drill bit, which is only available from a company identified as In-Lite Design Corporation of Ontario, Canada. As a result, any individual or company that may be interested in selling or installing the lighting system covered by the Gavigan '144 Patent must first obtain separate drill bits (both original and replacement bits) from In-Lite, thereby increasing the expense for producing the lighting system disclosed therein.

SUMMARY OF THE INVENTION

The present invention overcomes the disadvantages and shortcomings of the prior art discussed above by providing a new and improved paver/lighting fixture combination. The combination includes a masonry structure (e.g., a paver) having an exterior surface, an interior surface opposite the exterior surface, and an aperture that extends through the exterior surface to the interior surface of the masonry structure. The aperture has a substantially constant diameter from the exterior surface to the interior surface of the masonry structure.

The lighting fixture includes a support member that is positioned within the aperture of the masonry structure and provides structural support for a modular light assembly removably mounted to one end of the support member proximate to the exterior surface of the masonry structure. More particularly, the support member includes a first locking member positioned at one end of the support member proximate to the exterior surface of the masonry structure. The modular light assembly includes a second locking member that corresponds with and engages the first locking member of the support member. The first and second locking members are releasably enagagable with each other by turning the modular light assembly relative to the support member. This configuration allows a user to easily install and remove the modular light assembly on and from the support member.

In accordance with another aspect of the present invention, an electrical socket is removably received within a cavity of the support member. The modular light assembly is releasably connected to the socket such that the socket is removed from the cavity of the support member as the modular light assembly is removed from the support member. As a result, the modular light assembly can be disconnected from the socket for the purposes of repair or replacement externally of the masonry structure.

In accordance with another aspect of the present invention, the support member includes a first portion and a second portion releasably attached to the first portion. In one embodiment of the invention, the first and second portions may be hermaphroditic and identical to one another. In an alternate embodiment of the invention, the first portion of the support member is radially expandable in order to secure the lighting fixture within the aperture of the masonry structure. In another embodiment of the invention, the first and second portions are threadedly engagable with each other such that the height of the support member is adjustable, which allows the modular light assembly to be positioned flush with the exterior surface of the masonry structure. In yet another embodiment of the invention, the first portion of the support member includes a plurality of recesses, and the second portion of the support member includes a plurality of splines, each spline being sized and shaped so as to be receivable in a corresponding one of the recesses, thereby inhibiting the relative rotation between the first and second portions.

In accordance with another aspect of the present invention, the support member includes a flange for inhibiting the support member from exiting the aperture of the masonry structure at the exterior surface of the masonry structure. In addition, the modular light assembly is prevented from recessing too far below the exterior surface of the masonry structure. The support member may also include a plurality of fins that inhibit the rotation of the support member relative to the masonry structure.

Specifically, the present invention has been adapted for use as a component of driveways, walkways and patios. However, the present invention can be utilized as a component for other structures. Further features and advantages of the invention will appear more clearly on a reading of the detailed description of the exemplary embodiments of the invention, which are given below by way of example only with reference to the accompanying drawings.

BRIEF DESCRIPTION OF THE DRAWING

For a better understanding of the present invention, reference is made to the following detailed description of the exemplary embodiments considered in conjunction with the accompanying drawings, in which.

DETAILED DESCRIPTION OF THE DRAWINGS

Figure 1:
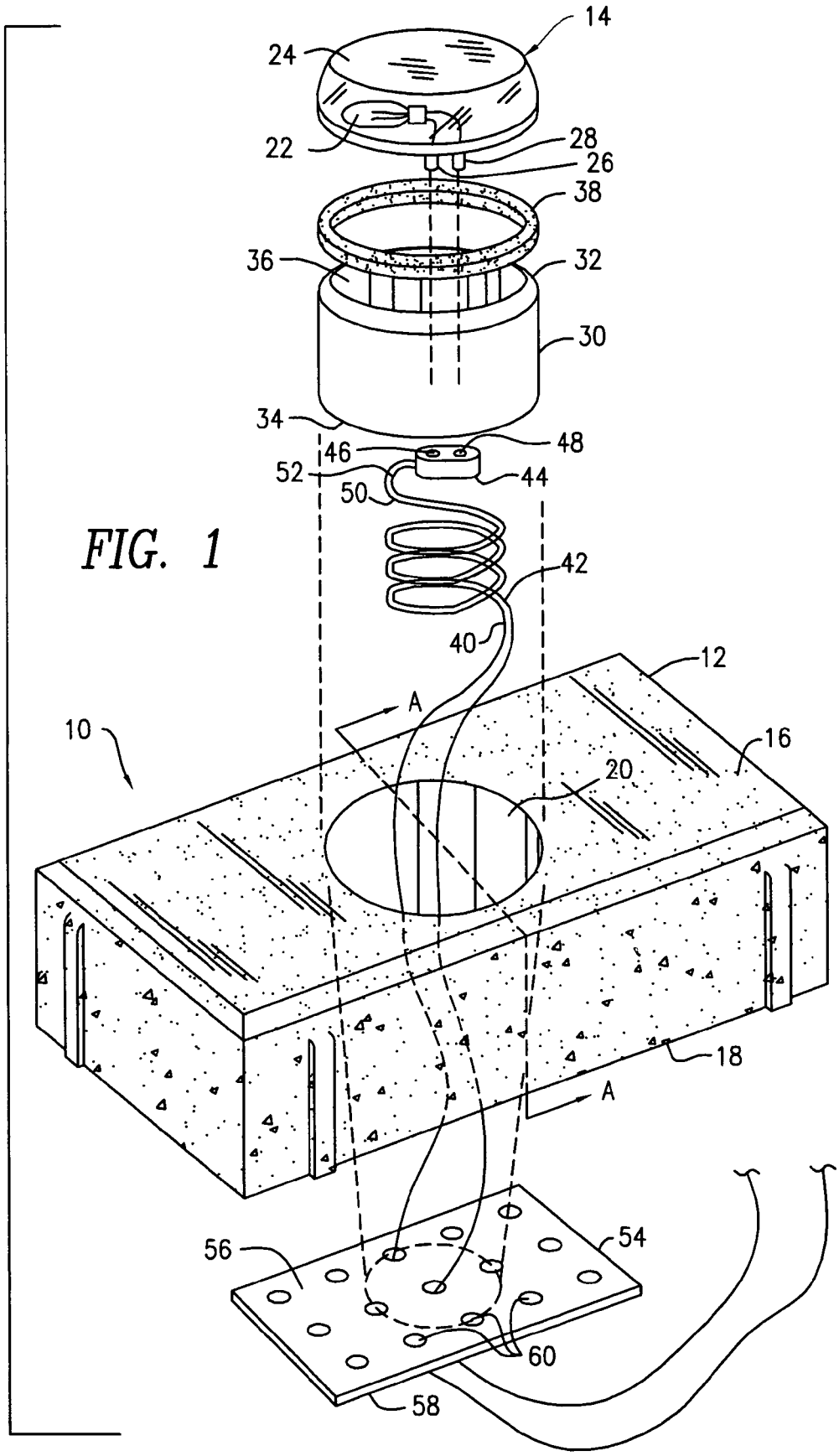
FIG. 1 is an exploded perspective view of a paver/light combination constructed in accordance with one exemplary embodiment of the present invention.
Figure 2:
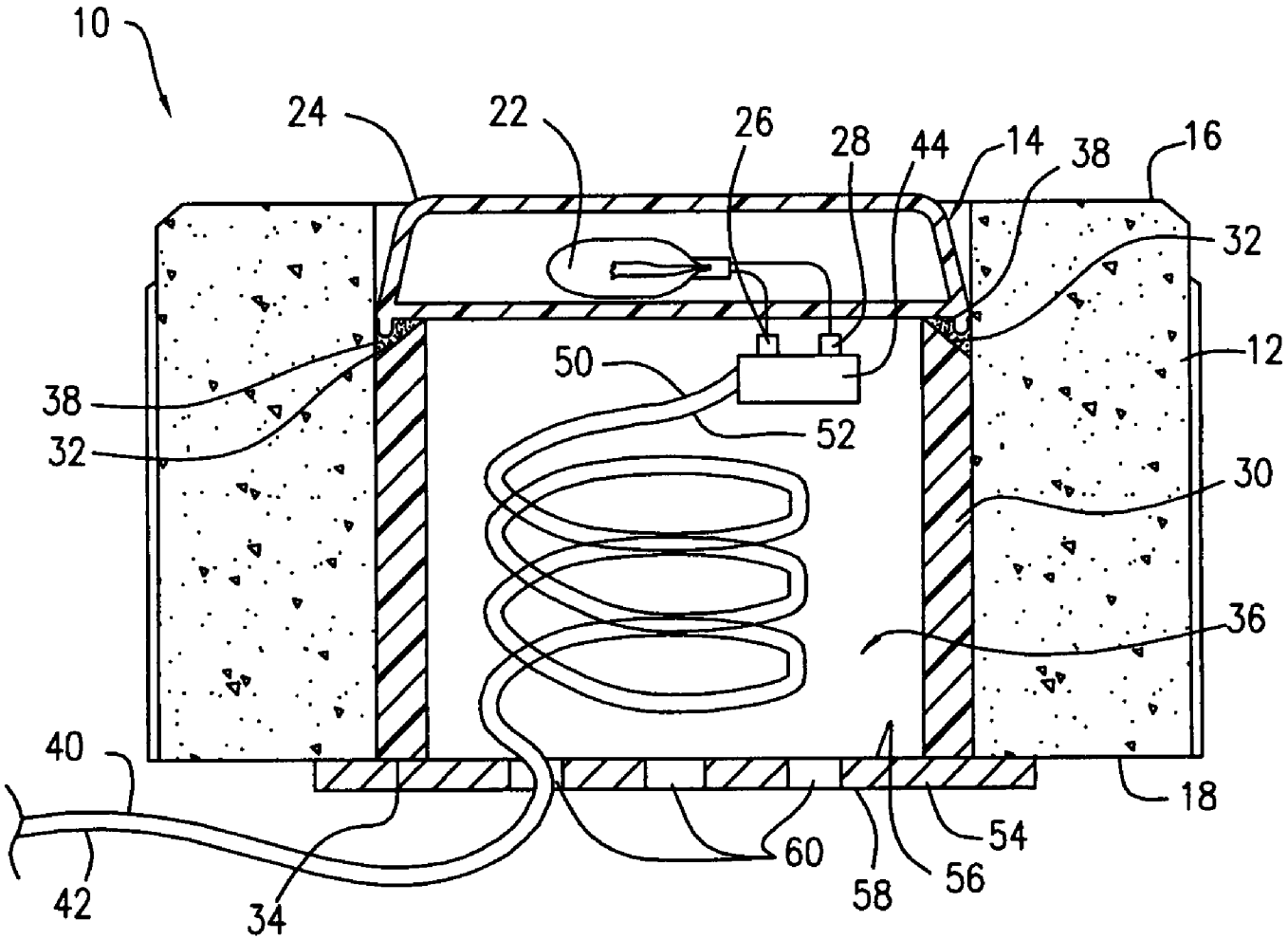
FIG. 2 is a cross-sectional view, taken along section line A-A and looking in the direction of the arrows, of the paver/light combination shown in FIG. 1.

Referring to FIGS. 1 and 2, a paver/light combination 10 includes a rectangular-shaped paver 12 and a disc-shaped modular light assembly 14, whose features and function shall be described hereinafter. The paver 12 includes an exterior surface 16 and an interior surface 18 opposite the exterior surface 16. A circular-shaped aperture 20 extends longitudinally from the exterior surface 16 to the interior surface 18 of the paver 12. The aperture 20 is sized and shaped so that the light assembly 14, as well other components of the paver/light combination 10, can be accommodated within the paver 12.

Still referring to FIGS. 1 and 2, the light assembly 14 includes an incandescent bulb 22, a disc-shaped lens cap 24 which shields the bulb 22, and a pair of plug-like connectors 26, 28. The lens cap 24 is preferably waterproof and substantially transparent. Alternatively, the lens cap 24 can consist of different colors and/or can be modified to an opaque frosted finish (for instance, by sanding it with sandpaper) for aesthetic appeal. Preferably, the candlepower of the bulb 22 is sufficient to illuminate a driveway, walkway, patio or stairway in which the paver/light combination 10 is installed. Alternatively, other light sources, such as, for example, a light emitting diode ("LED") may be used in place of the bulb 22.

Still referring to FIGS. 1 and 2, the paver/light combination 10 includes a tubular-shaped support sleeve 30 having a first end 32, a second end 34 opposite the first end 32, and a centrally located cylindrical-shaped cavity 36 located between the first end 32 and the second end 34. The first end 32 of the support sleeve 30 is preferably tapered or beveled (as shown in FIGS. 1 and 2), but it need not be. The light assembly 14 is removably mounted to the first end 32 of the support sleeve 30 by an adhesive 38. The adhesive 38 may be, but is not limited to, materials commonly known in the art as "electricians putty" or "pavement adhesive", which, while providing a flexible watertight seal, may be removed if necessary. The support sleeve 30 is removably installed within the aperture 20 of the paver 12 such that the first end 32 of the support sleeve 30 is recessed from the exterior surface 16 of the paver 12 and the light assembly 14 is positioned proximate to the exterior surface 16 of the paver 12.

Still referring to FIGS. 1 and 2, a pair of electrical wires 40, 42 passes under the interior surface 18 of the paver 12 and enters the cavity 36 of the support sleeve 30. The wires 40, 42 supply low voltage current to the light assembly 14. A socket 44, having a pair of receptacles 46, 48, is connected at one end 50 of the wire 40 and at one end 52 of the wire 42. Preferably, dielectric grease is disposed on and around the receptacles 46, 48 to prevent corrosion of the socket 44. The connectors 26, 28 of the light assembly 14 mate respectively with the receptacles 46, 48 of the socket 44. The wires 40, 42 are preferably coiled inside the cavity 36 of the support sleeve 30. In this regard, the wires 40, 42 have a predetermined length that allows for the removal of the light assembly 14 and the socket 44 from the support sleeve 30 for the purposes of repair or replacement of the light assembly 14 externally of the paver 12.

Still referring to FIGS. 1 and 2, the paver/light combination 10 includes a rectangular-shaped support plate 54 having a first surface 56 and a second surface 58 opposite thereto. The function of the plate 54 shall be described hereinafter. A plurality of circular-shaped holes 60 extend longitudinally from the first surface 56 to the second surface 58 of the plate 54. The first surface 56 of the plate 54 engages the interior surface 18 of the paver 12 and substantially obstructs the aperture 20 in the paver 12. The plate 54 may be attached to the paver 12, but it need not be. In this configuration, the second end 34 of the support sleeve 30 engages the first surface 56 of the plate 54.

It is noted that the paver 12 preferably consists of a rectangular-brick shape, but it can consist of other shapes and sizes. The plate 54 is preferably rectangular in shape, but it can consist of other shapes and sizes. While the aperture 20 in the paver 12 and the cavity 36 of the support sleeve 30 are each preferably cylindrical in shape, it should be noted that each can consist of other shapes and sizes. Also, the holes 60 of the plate 54 are each preferably circular in shape, but each can consist of other shapes and sizes. In addition, the light assembly 14 is preferably disc-shaped, but it can consist of other shapes and sizes. Finally, the support sleeve 30 is preferably tubular in shape, but it can consist of other shapes and sizes.

It is also noted that the paver 12 is preferably manufactured from a masonry material, such as poured concrete or fired clay type building brick. Alternatively, the paver 12 can be manufactured from other materials. In addition, the lens cap 24 of the light assembly 14 is preferably made from high impact polycarbonate, but it can be made from other materials. The support plate 54 is preferably manufactured from a thin flexible corrosion resistant material, such as galvanized steel, or from aluminum. Alternatively, the support plate 54 can be manufactured from other materials. Finally, the support sleeve 30 is preferably manufactured from PVC pipe, but it can be manufactured from other materials.

The light assembly 14 may be obtained commercially from Truck-Lite Inc., of Falconer, N.Y. model number 10, part number 10202. Alternatively, the light assembly 14 can be supplied by other manufacturers and/or be characterized by other model and part numbers.

In preparation for use of the paver/light combination 10, the light assembly 14 is connected to the socket 44 externally of the paver 12. More particularly, the connector 26 of the light assembly 14 is connected to the receptacle 46 of the socket 44, while the connector 28 of the light assembly 14 is connected to the receptacle 48 of the socket 44. An end of the wire 40 opposite the end 50 thereof and an end of the wire 42 opposite the end 52 thereof are each connected to a power supply (not shown in FIGS. 1 and 2). The power supply has a preferable voltage of 12 volts, but it may have another voltage. Each of the wires 40, 42 is fed through one of the holes 60 of the support plate 54. Alternatively, the wires 40, 42 may be fed through an opening formed between an edge of the plate 54 and the aperture 20 of the base 12 (not shown in FIGS. 1 and 2).

The plate 56 acts as a stop to prevent the support sleeve 30 from being pressed into a bedding substrate (not shown in FIGS. 1 and 2), in the event that a force is applied directly on top of the light assembly 14. In turn, the light assembly 14 is prevented from traveling too far below the exterior surface 18 of the paver 12, thereby allowing the light assembly 14 to support vertical loading.

Because the paver/light combination 10 is designed for installation within an area populated with conventional pavers, the light assembly 14 is configured to be removed from the paver 12 without having to remove any of the conventional pavers (not shown in the Figures). More particularly, the light assembly 14 may be removed from the paver 12 with a common screwdriver or similar implement by simply prying the light assembly 14 out of the aperture 20 of the paver 12. In this regard, the light assembly 14 can be quickly and easily disconnected from the socket 44 externally from the paver 12 and replaced with a new light assembly 14 and reinstalled into the paver 12. Furthermore, because the light assembly 14 is preferably manufactured as a sealed modular unit, replacement of the entire light assembly 14 is possible, thus gaining a new light source and housing.

In addition, the paver 12 may be supplied with the light assembly 14 in the form of a kit or the paver 12 may be acquired separately and modified at the construction site from preexisting masonry block. If supplied with the light assembly 14 in a kit, the aperture 20 in the paver 12 may be pre-cast or otherwise formed therein during manufacture of the masonry block. If a masonry block is to be modified at the construction site to accept the light assembly 14, the aperture 20 in the paver 12 may be created through the masonry block using commonly available tools such as drills or drill presses. One tool that may be used to create the aperture 20 is a diamond tipped piloted core bit used in combination with a drill or drill press. The piloted core bit creates the aperture 20 by boring a hole straight through the masonry block.

Figure 3:
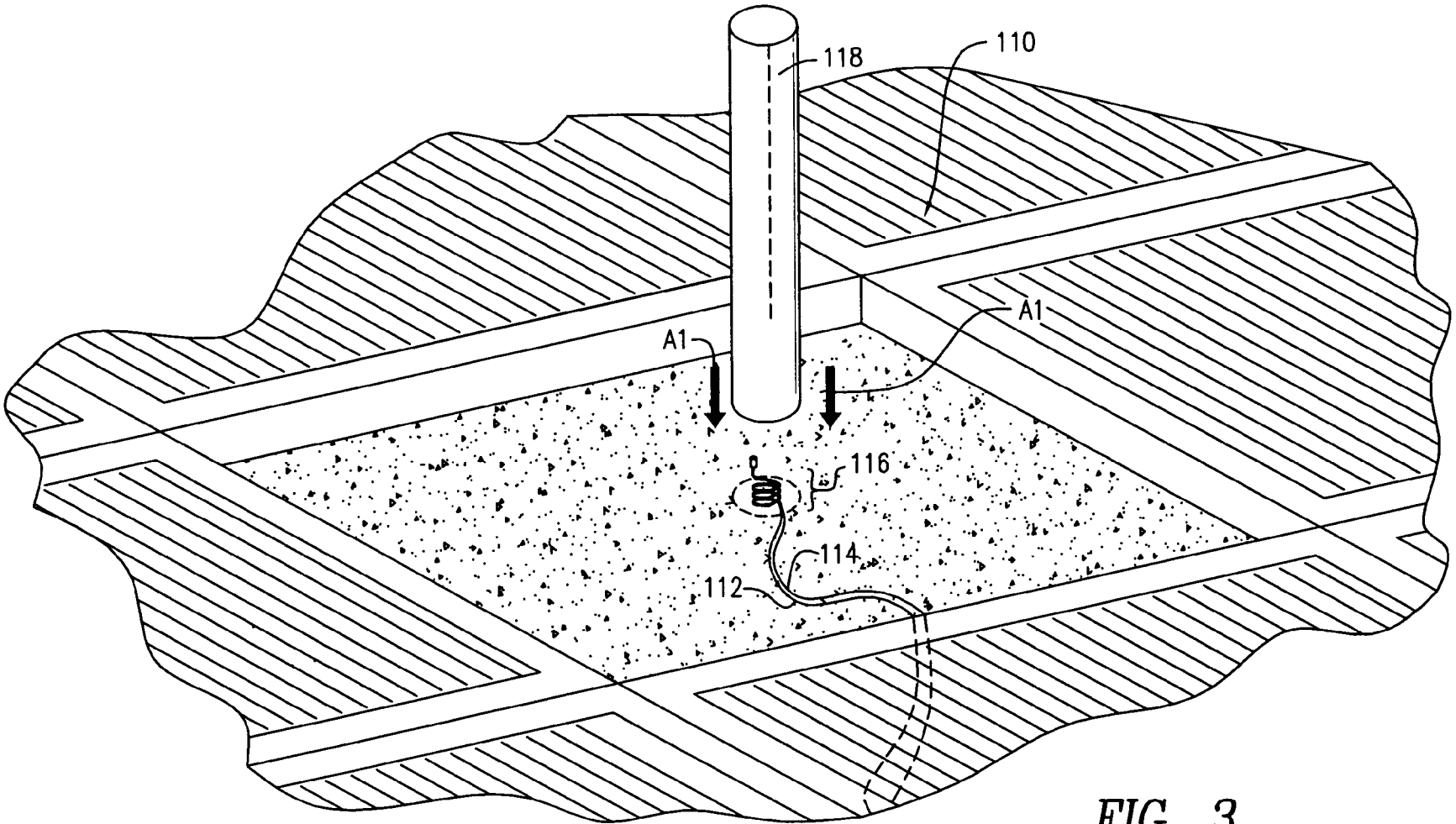
FIGS. 3, 4 and 5 are sequential perspective views of the steps involved in the in situ construction of a walkway light in accordance with another embodiment of the present invention.
Figure 4:
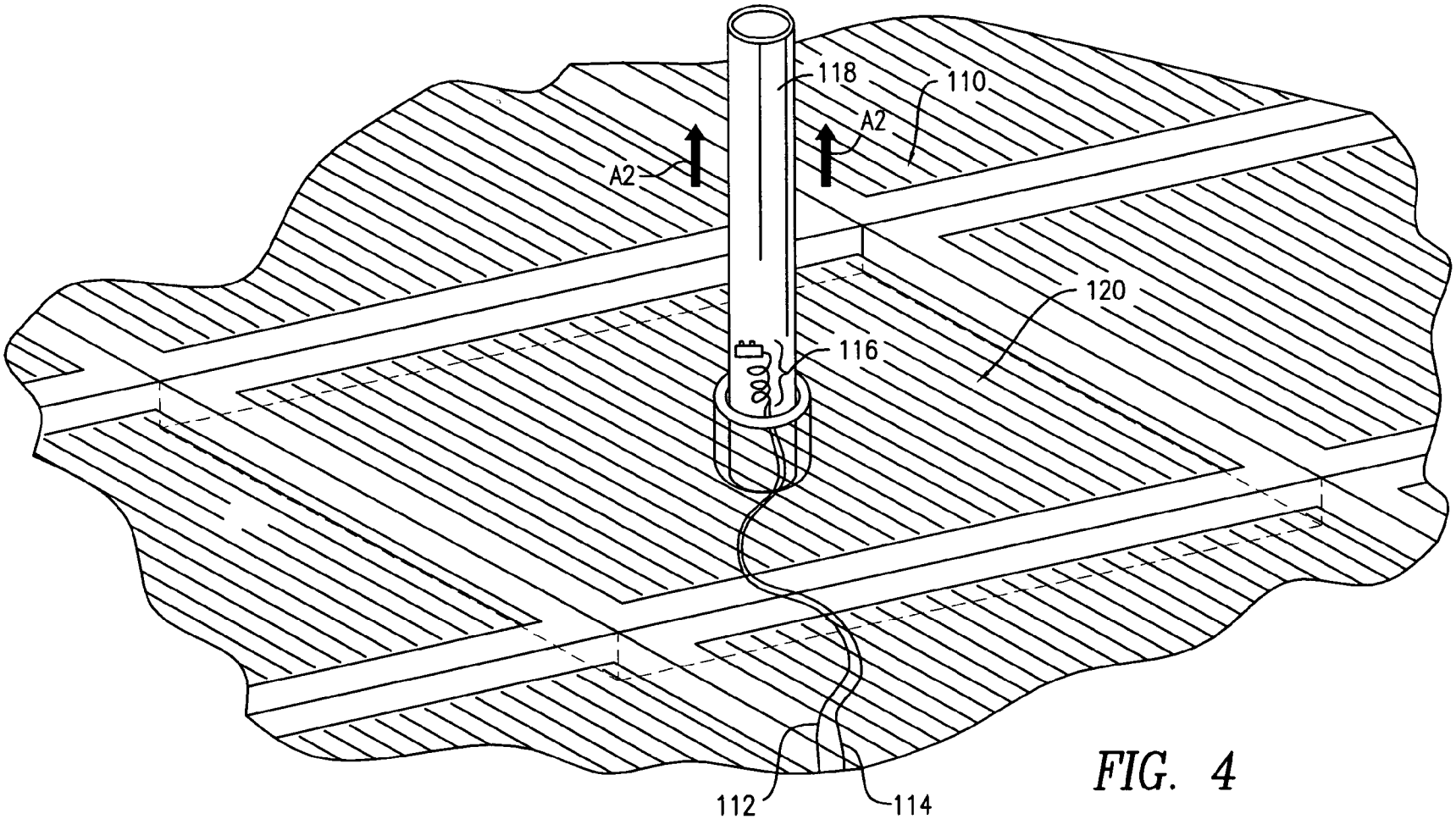
Figure 5:
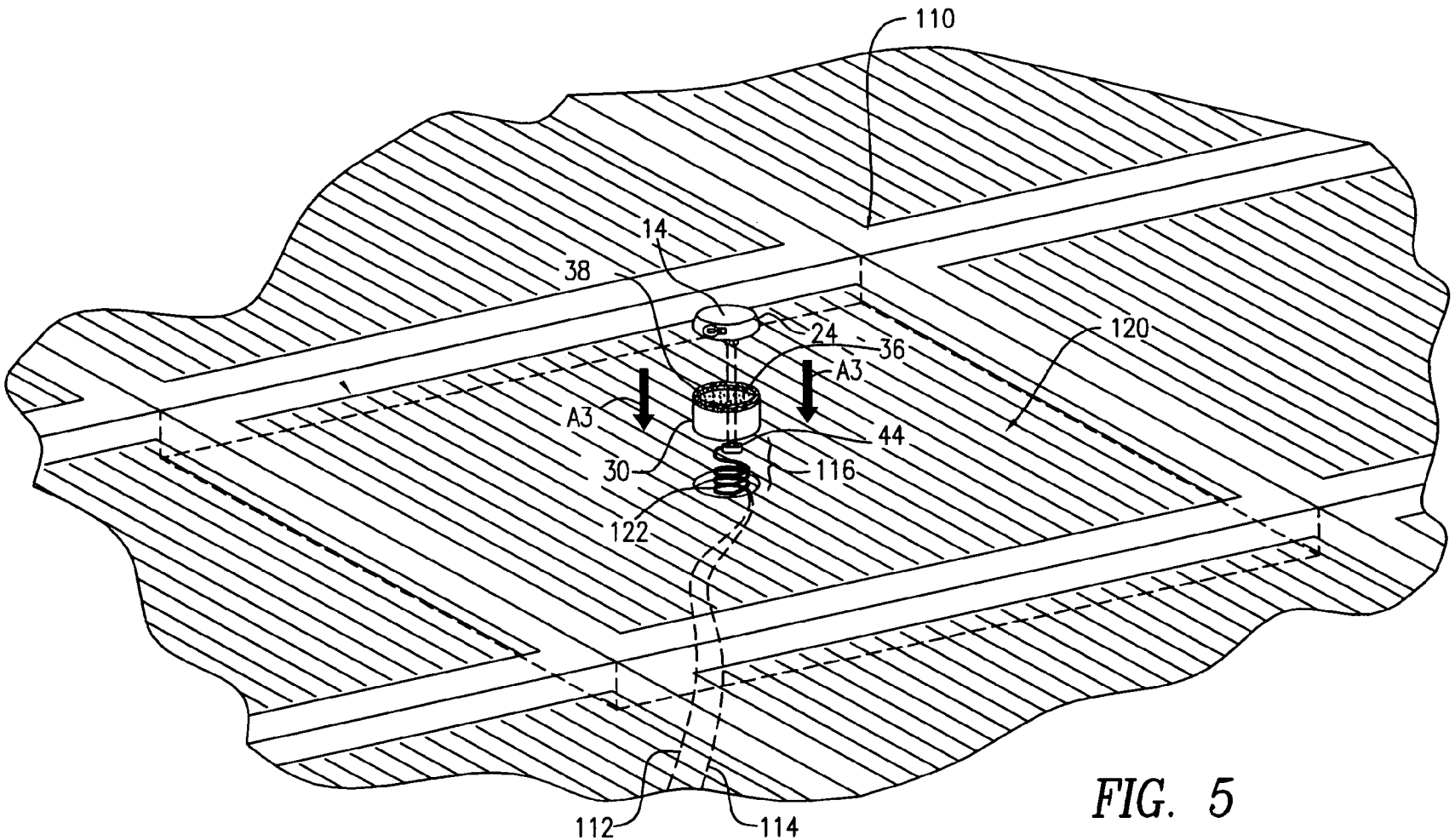

FIGS. 3, 4 and 5 show the sequential steps involved in the in situ construction of a walkway light at a site 110. More particularly, FIG. 3 shows the first step in the construction process, whereby a predetermined length of wires 112, 114 is laid on the site 110. An excess portion of the wires 112, 114 is rolled to form a coiled portion 116, which is positioned at the intended location of a light assembly (not shown in FIG. 3). A tube 118 is then placed over the coiled portion 116 of the wires 112, 114, as depicted by arrows A1 in FIG. 3.

Referring now to FIG. 4, after the tube 118 has been temporarily affixed in place, concrete is poured onto the site 110 and trowelled around the tube 118. The poured concrete cures to form a concrete pad or base 120. It is noted that the tube 118 has generally the same outer wall diameter as the overall outer diameter of a support sleeve 122 (see FIG. 5) to be installed within the base 120. The tube 118 may be formed of metal or plastic, such as polyvinyl chloride (PVC). The length of the tube 118 depends upon the thickness of the base 120 to be formed, but usually a length of a couple of feet is sufficient. Once the tube 118 has been secured over the coiled portion 116 of the wires 112, 114, the base 120 may be formed as described above.

While concrete is the preferred masonry product used to form the base 120, other masonry products may be used. Concrete is a preferred masonry material because of its fast set up and cure time, as well as its inherent strength as a building material. Concrete is commonly used in the construction of driveways, walkways, staircases and patios.

It should be understood that the wires 112, 114 may be laid under the base 120 or embedded within it. Either method is acceptable, as concrete does not adversely affect the wires 112, 114 or their function. Once the concrete has set as shown in FIG. 4 to form the base 120, the tube 118 is removed from the base 120 by pulling up and out, as depicted by arrows A2, leaving the coiled section 116 of the wires 112, 114 exposed and resulting in an aperture 122.

Referring now to FIG. 5, after the base 120 has set and the tube 118 has been removed, the site 110 is ready for the installation of light assembly 124. The coiled portion 116 of the wires 112, 114 is taken out of the aperture 122 of the base 120, uncoiled and threaded through a cavity 126 of a support sleeve 128. The light assembly 124 is then connected to a socket 130 and a bead of adhesive 132 is placed between an end 134 of the support sleeve 128 and the light assembly 124.

Any slack in the wires 112, 114 is taken up by recoiling them. After the recoiled section 116 is placed inside the cavity 126, the support sleeve 128 is placed into the aperture 122 of the base 120. Once inside the aperture 122, the light assembly 124 is positioned such that an associated lens cap 136 is flush with the exterior surface of the base 120.

Figure 6:
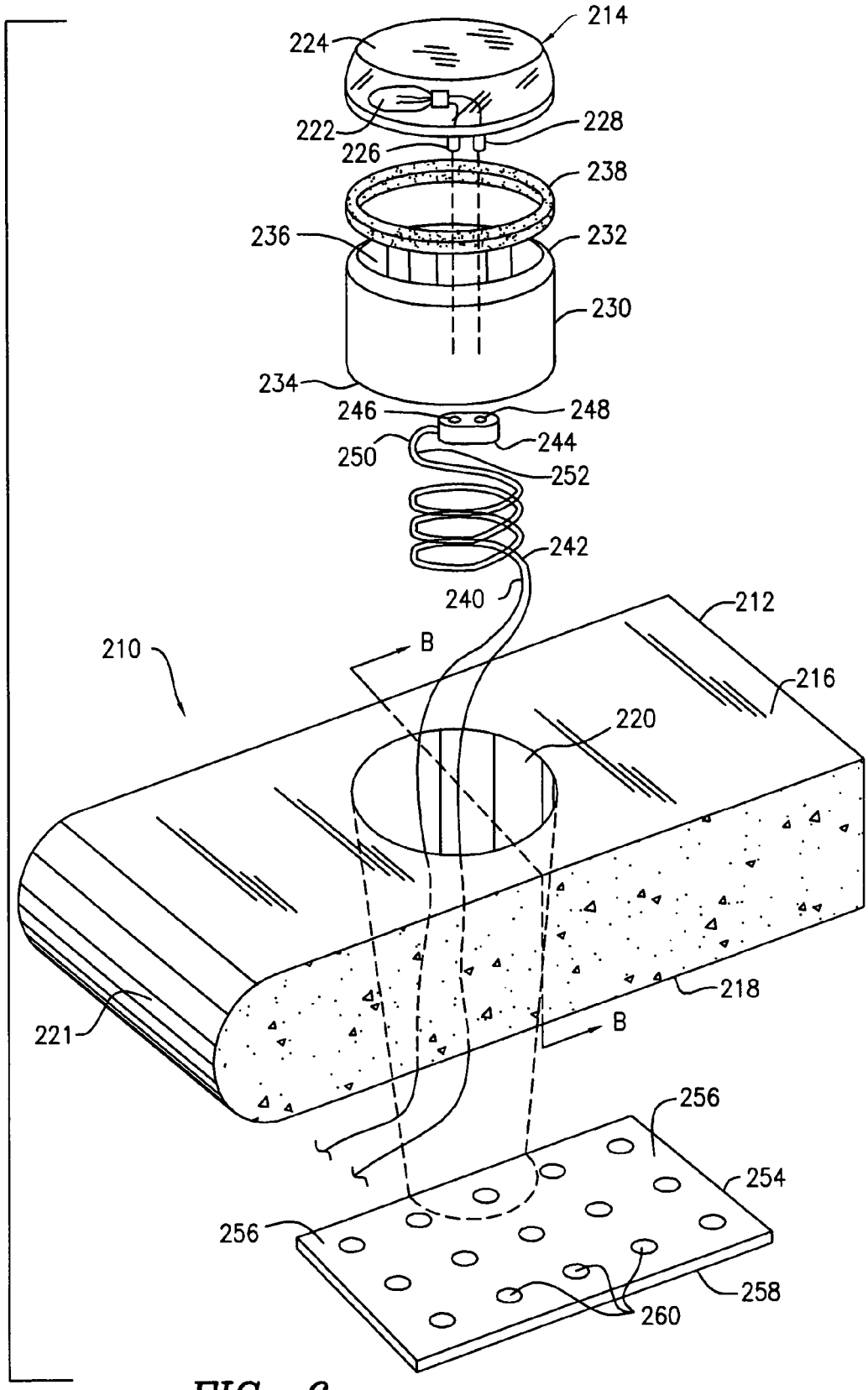
FIG. 6 is an exploded perspective view of a paver/light combination in accordance with a further exemplary embodiment of the present invention.
Figure 7:
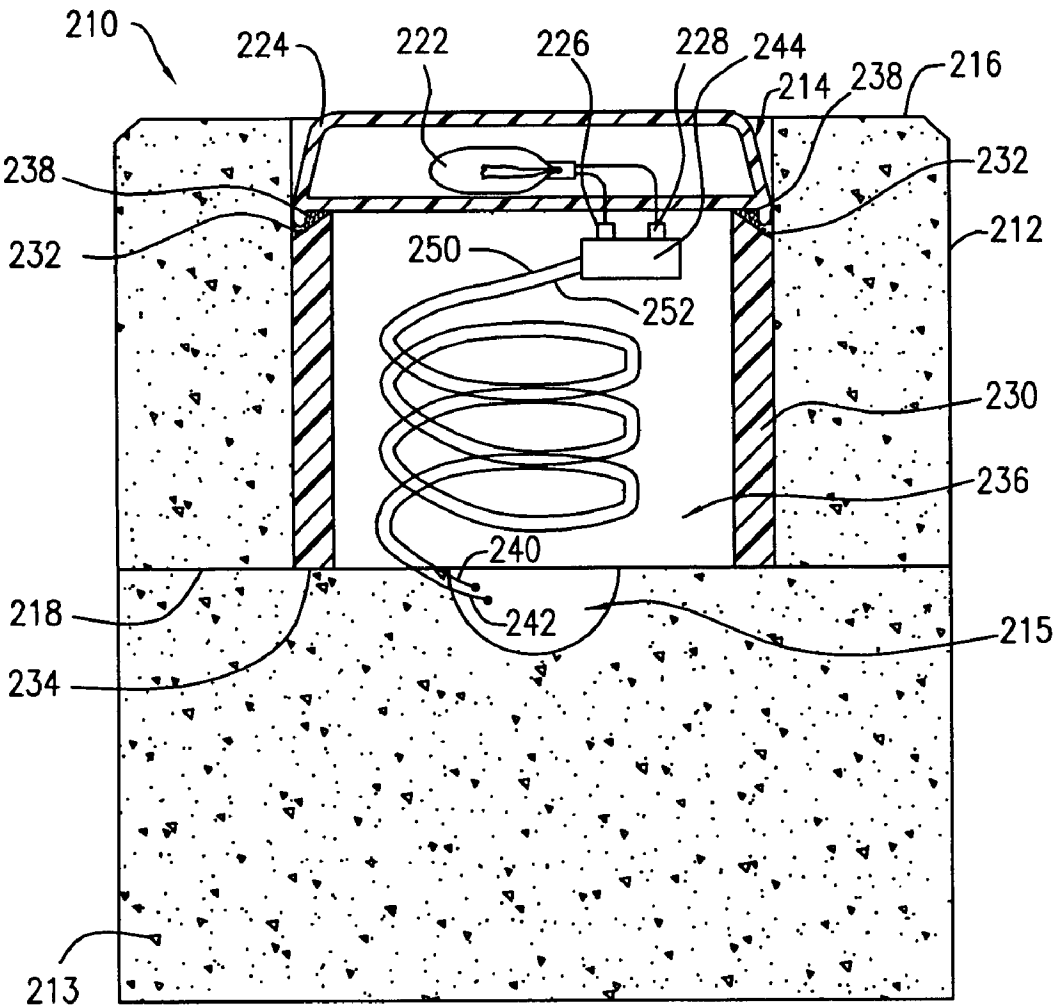
FIG. 7 is a cross-sectional view, taken along section line B-B and looking in the direction of the arrows, of the paver/light combination shown in FIG. 6.

Referring to FIGS. 6 and 7, a paver/light combination 210 includes a substantially rectangular-shaped paver 212 and a disc-shaped modular light assembly 214, whose features and function shall be described hereinafter. The paver 212 includes an exterior surface 216 and an interior surface 218 opposite the exterior surface 216. A circular-shaped aperture 220 extends longitudinally from the exterior surface 216 to the interior surface 218 of the paver 212. The aperture 220 is sized and shaped so that the light assembly 214, as well as other components of the paver/light combination 210, can be accommodated within the paver 212, which includes a rounded end 221 typical of pavers utilized in the construction of outdoor masonry staircases and swimming pool coping.

Still referring to FIGS. 6 and 7, the light assembly 214 includes an incandescent bulb 222, a disc-shaped lens cap 224 which shields the bulb 222, and a pair of plug-like connectors 226, 228. The lens cap 224 is preferably waterproof and substantially transparent. Alternatively, the lens cap 224 can consist of different colors for aesthetic appeal. Preferably, the candlepower of the bulb 222 is sufficient to illuminate a driveway, walkway, patio or stairway in which the paver/light combination 210 is installed. Alternatively, other light sources, such as, for example, a light emitting diode ("LED") (not shown in FIGS. 6 and 7), may be used in place of the incandescent bulb 222.

Still referring to FIGS. 6 and 7, the paver/light combination 210 includes a tubular-shaped support sleeve 230 having a first end 232, a second end 234 opposite the first end 232, and a centrally located circular-shaped cavity 236 located between the first end 232 and the second end 234. The first end 232 of the support sleeve 230 is preferably tapered (as shown in FIGS. 6 and 7), but it need not be. The light assembly 214 is removably mounted to the first end 232 of the support sleeve 230 by an adhesive 238. The adhesive 238 may be, but is not limited to, materials commonly known in the art as "electricians putty" or "pavement adhesive", which, while providing a flexible watertight seal, may be removed if necessary. The support sleeve 230 is removably installed within the aperture 220 of the paver 212 such that the first end 232 of the support sleeve 230 is recessed from the exterior surface 216 of the paver 212 and the light assembly 214 is positioned proximate to the exterior surface 216 of the paver 212.

Still referring to FIGS. 6 and 7, a pair of electrical wires 240, 242 passes under the interior surface 218 of the paver 212 and enters the cavity 236 of the support sleeve 230. The wires 240, 242 supply low voltage current to the light assembly 214.

Referring specifically to FIG. 7, the paver/light combination 210 is shown laid on a solid block 213. The wires 232, 234 are positioned within a channel 215 formed across the solid block 213. The channel 215 may be formed using commonly available tools, such as chisels or saws.

Referring back to both FIGS. 6 and 7, a socket 244, having a pair of receptacles 246, 248, is connected at one end 250 of the wire 240 and at one end 252 of the wire 242. Preferably, dielectric grease is disposed on and around the receptacles 246, 248 to prevent corrosion of the socket 244. The connectors 226, 228 of the light assembly 214 mate respectively with the receptacles 238, 240 of the socket 244. The wires 240, 242 are preferably coiled inside the cavity 236 of the support sleeve 230. In this regard, the wires 240, 242 have a predetermined length that allows for the removal of the light assembly 214 and the socket 244 from the support sleeve 230 for the purposes of repair or replacement of the light assembly 214 externally of the paver 212.

Referring now to FIG. 6, the paver/light combination 210 includes a rectangular-shaped support plate 254 having a first surface 256 and a second surface 258 opposite thereto. A plurality of circular-shaped holes 260 extend longitudinally from the first surface 256 to the second surface 258 of the plate 254. The first surface 256 of the plate 254 is juxtaposed with the second surface 218 of the paver 212. More particularly, the plate 254 is positioned to one side of the aperture 220 of the paver 212 (i.e., it is laterally offset relative to the aperture 220), rather than being positioned directly below the aperture 220 of the paver 212 as in the embodiment of the paver 10 shown in FIGS. 1 and 2. Such offset positioning of the plate 254 is necessitated because, when the paver/light combination 210 is located over a void, the plate 254 must be relocated to span or be supported by a run of a staircase stringer (not shown in FIGS. 6 and 7) or other supportive medium.

Although the plate 254 is preferably rectangular in shape, it can consist of other shapes and sizes. While the aperture 220 of the paver 212 and the cavity 236 of the support sleeve 230 are each preferably cylindrical in shape, it should be noted that each can consist of other shapes and sizes. Also, the holes 260 of the plate 254 are each preferably circular in shape, but each can consist of other shapes and sizes. In addition, the lens cap 224 is preferably disc-shaped, but it can consist of other shapes and sizes. Finally, the support sleeve 230 is preferably tubular in shape, but it can consist of other shapes and sizes.

It is also noted that the paver 212 is preferably manufactured from a masonry material, such as poured concrete or fired clay type building brick. Alternatively, the paver 212 can be manufactured from other materials. In addition, the lens cap 224 of the light assembly 214 is preferably made from high impact polycarbonate, but it can be made from other materials. The support plate 254 is preferably manufactured from a thin flexible corrosion resistant material, such as galvanized steel, or aluminum. Alternatively, the support plate 254 can be manufactured from other materials. Finally, the support sleeve 230 is preferably manufactured from PVC pipe, but it can be manufactured from other materials.

Moreover, a suitable light assembly 214 may be obtained commercially from Truck-Lite Inc., of Falconer, N.Y., model number 10, part number 10202. Alternatively, the light assembly 214 can be supplied by other manufacturers and/or be characterized by other model and part numbers.

In preparation for use of the paver/light combination 210, the light assembly 214 is connected to the socket 244 externally of the paver 212. More particularly, the connector 226 of the light assembly 214 is connected to the receptacle 246 of the socket 244, while the connector 228 of the light assembly 214 is connected to the receptacle 248 of the socket 244. An end of the wire 240 opposite the end 250 thereof and an end of the wire 242 opposite the end 252 thereof are each connected to a power supply (not shown in FIGS. 6 and 7). The power supply has a preferable voltage of 12 volts, but it may have another voltage. The wires 240, 242 are fed through one of the holes 260 of the support plate 254. Alternatively, the wires 240, 242 may be fed through an opening formed between an edge of the plate 254 and the aperture 220 of the paver 212 (not shown in FIGS. 6 and 7).

The plate 256 acts as a stop to prevent the support sleeve 230 from being pressed into a bedding substrate (not shown in FIGS. 6 and 7) that the paver/light combination 210 is laid on, in the event that a force is applied directly on top of the light assembly 214. In turn, the light assembly 214 is prevented from traveling too far below the exterior surface 218 of the paver 212, thereby allowing the light assembly 214 to support vertical loading.

Because the paver/light combination 210 is designed for installation within an area populated with other pavers, the light assembly 214 is configured to be removed from the paver 212 without having to remove any of the other pavers (not shown in the Figures). More particularly, the light assembly 214 may be removed from the paver 212 with a common screwdriver or similar implement by simply prying the light assembly 214 out of the aperture 220 of the paver 212. In this regard, the light assembly 214 can be quickly and easily disconnected from the socket 244 externally from the paver 212 and replaced with a new light assembly 214 and reinstalled into the paver 212. Furthermore, because the light assembly 214 is preferably manufactured as a sealed modular unit, replacement of the entire light assembly 214 is possible, thus gaining a new light source and housing.

Figure 8:
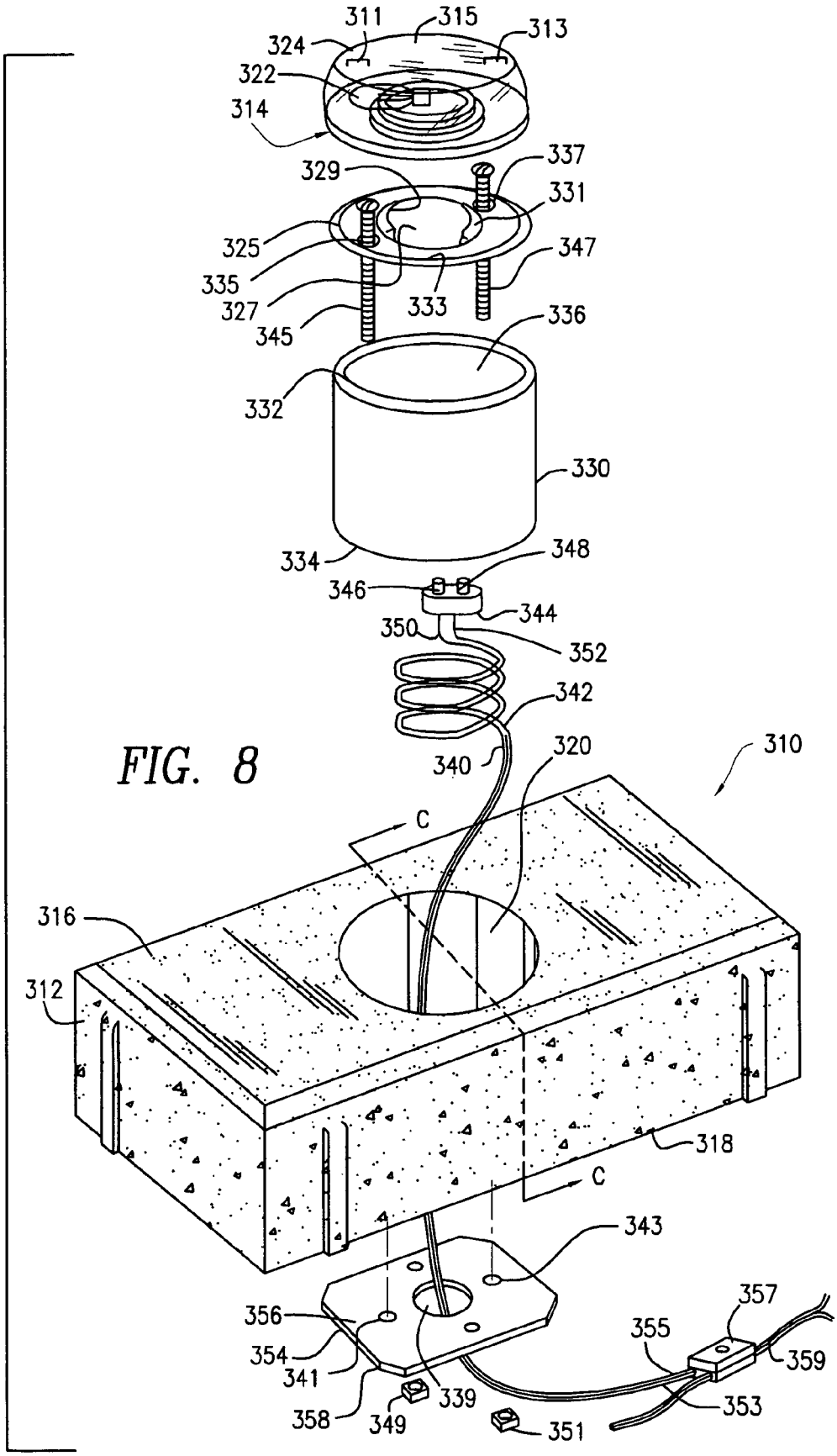
FIG. 8 is an exploded perspective view of a paver/light combination in accordance with yet another exemplary embodiment of the present invention.
Figure 9:
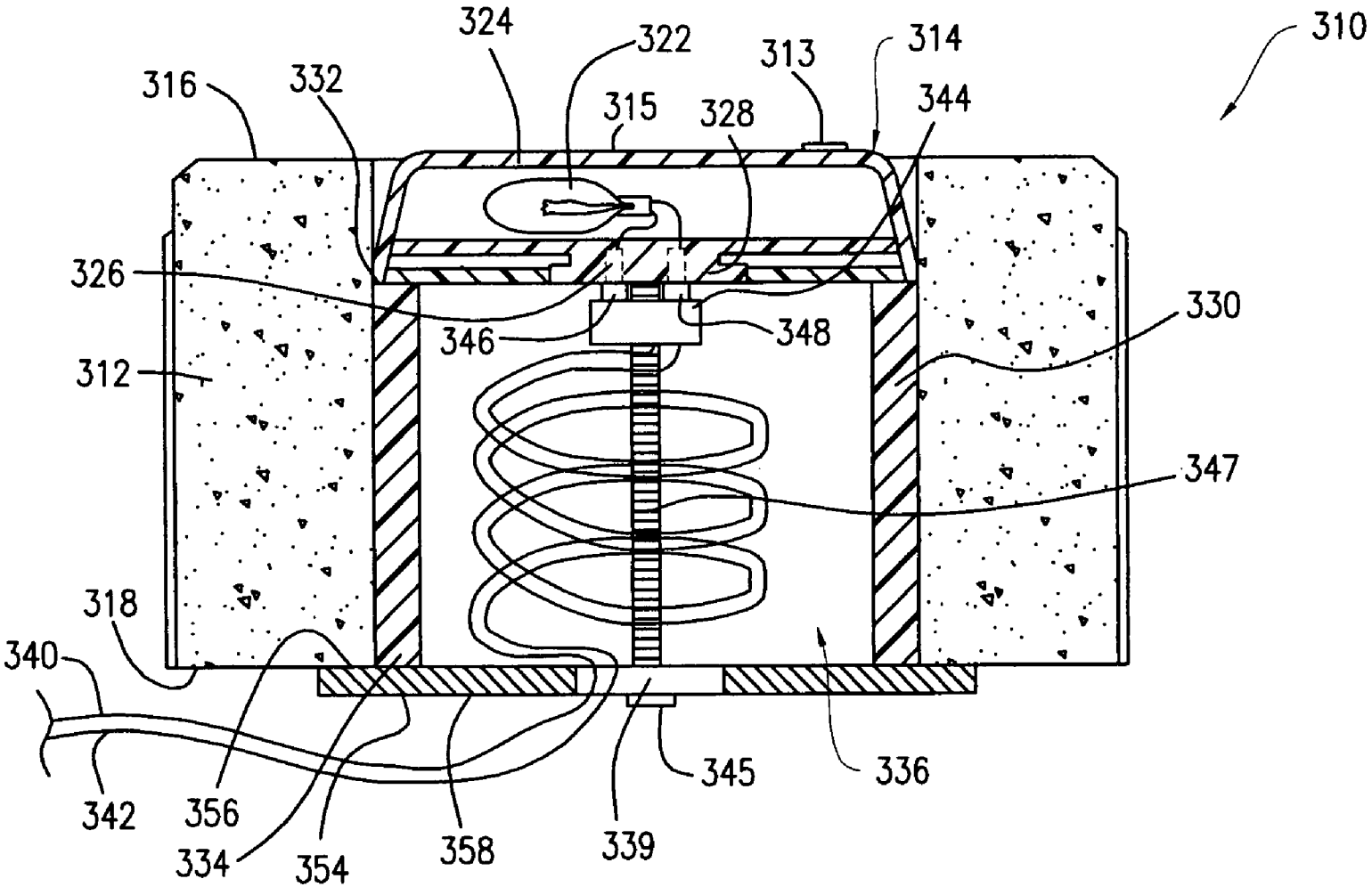
FIG. 9 is a cross-sectional view, taken along section line C-C and looking in the direction of the arrows, of the paver/light combination shown in FIG. 8.

Referring to FIGS. 8 and 9, a paver/light combination 310 includes a rectangular-shaped paver 312 and a light assembly 314, whose features and function shall be described hereinafter. The paver 312 includes an exterior surface 316 and an interior surface 318 opposite the exterior surface 316. A circular-shaped aperture 320 extends longitudinally from the exterior surface 316 to the interior surface 318 of the paver 312. The aperture 320 is sized and shaped so that the light assembly 314, as well as other components of the paver/light combination 310, can be accommodated within the paver 312.

Figure 10:
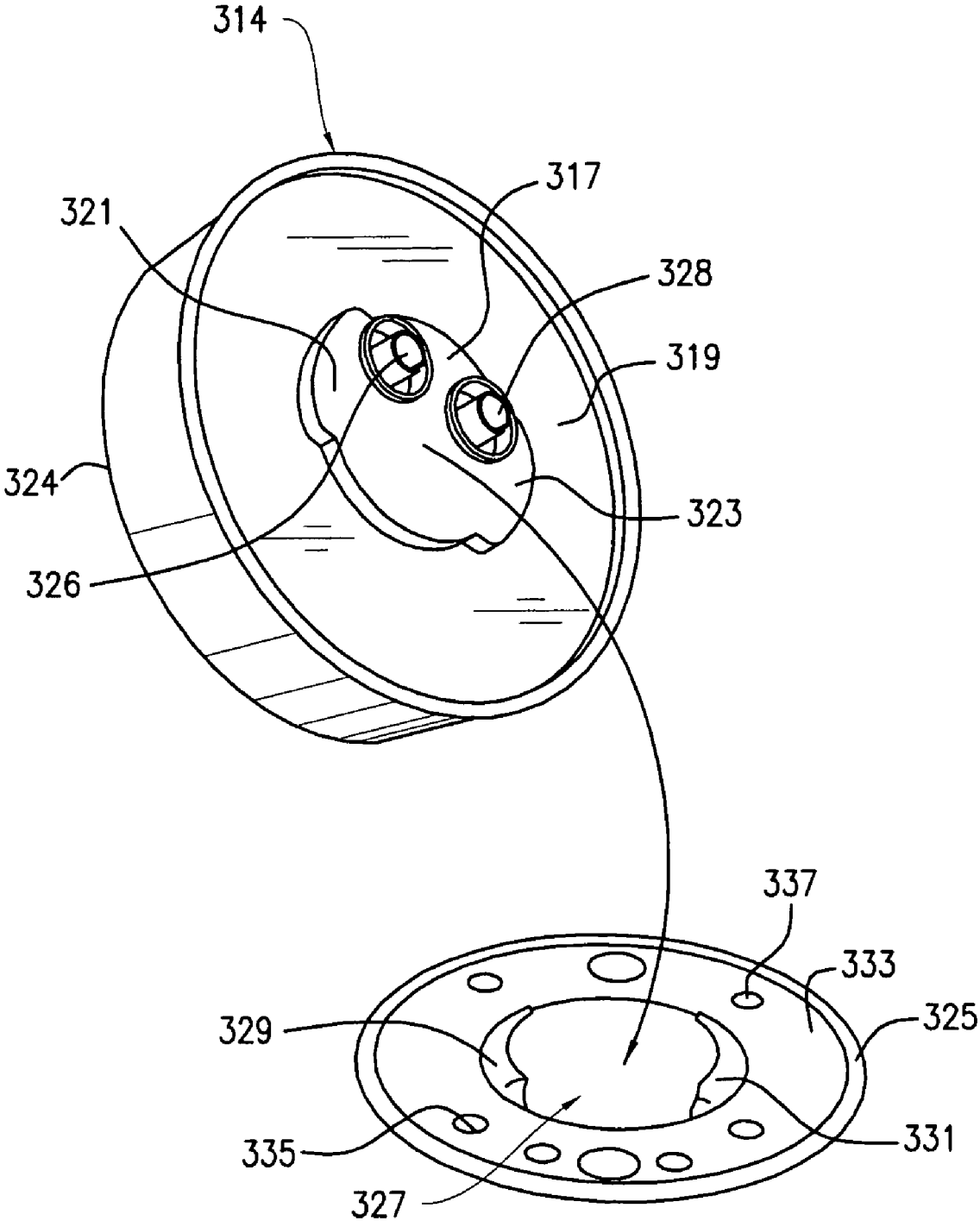
FIG. 10 is an exploded perspective view of a modular light assembly and an associated mounting bracket employed by the paver/light combination shown in FIGS. 8 and 9.

Referring now to FIGS. 8, 9 and 10, the light assembly 314 includes an incandescent bulb 322 and a disc-shaped lens cap 324 having a pair of diametrically opposed rectangular-shaped tabs 311, 313 that outwardly extend from a first surface of 315 of the lens cap 324. The function of the tabs 311, 313 shall be described hereinafter. The lens cap 324, which shields the bulb 322, is preferably waterproof and substantially transparent. Alternatively, the lens cap 324 can consist of different colors and/or can be modified to an opaque frosted finish (for instance, by sanding it with sandpaper) for aesthetic appeal. Preferably, the candlepower of the bulb 322 is sufficient to illuminate a driveway, walkway, patio or stairway in which the paver/light combination 310 is installed. Alternatively, other light sources, such as, for example, a light emitting diode ("LED") (not shown in FIGS. 8, 9 and 10), may be used in place of the incandescent bulb 322.

With particular reference to FIG. 10, the light assembly 314 includes a cam lock 317 formed on a bottom surface 319 thereof. The cam lock 317 includes a pair of diametrically opposed tabs 321, 323. A pair of plug-like connectors 326, 328 extend through and project from the cam lock 317. The function of the connectors 326, 328 and the cam lock 317 shall be described hereinafter.

Referring now to FIGS. 8 and 9, the paver/light combination 310 includes a tubular-shaped support sleeve 330 and a circular-shaped cam lock mounting bracket 325. The support sleeve includes a first end 332, a second end 334 opposite thereof, and a centrally located circular-shaped cavity 336 between the first end 332 and the second end 334. The bracket 325 includes a circular-shaped aperture 327, a pair of diametrically opposed locking tabs 329, 331 that are positioned about the periphery of the aperture 327 and outwardly extend from a first surface 333 of the bracket 325, and a pair of diametrically opposed circular-shaped screw holes 335, 337. The function of support sleeve 330 and the bracket 325 shall be described hereinafter.

Still referring to FIGS. 8 and 9, a pair of electrical wires 340, 342 passes under the second surface 318 of the paver 312 and enters the cavity 336 of the support sleeve 330. The wires 340, 342 supply low voltage current to the light assembly 314. A socket 344 having a pair of receptacles 346, 348 is connected at one end 350 of the wire 340 and at one end 352 of the wire 342. Preferably, dielectric grease (not shown in FIGS. 8 and 9) is disposed on and around the receptacles 346, 348 to prevent corrosion of the socket member 344. The connectors 326, 328 of the light assembly 314 mate respectively with the receptacles 338, 340 of the socket 344. The wires 340, 342 are preferably coiled inside the cavity 336 of the support sleeve 330 in order to facilitate the removal of the light assembly 314 and the socket 344 from the support sleeve 330 for the purposes of repair or replacement of the light assembly 314 externally of the paver 312.

Still referring to FIGS. 8 and 9, the paver/light combination 310 includes a square-shaped support plate 354 having a first surface 356 and a second surface 358 opposite thereof. A circular-shaped aperture 339 and a pair of circular-shaped holes 341, 343 each extend longitudinally from the first surface 356 to the second surface 358 of the plate 354. The first surface 356 of the plate 354 is juxtaposed with the second surface 318 of the paver 312 and positioned proximate to the aperture 320 of the paver 312.

In assembling the paver/light combination 310, a screw 345 is inserted into the hole 335 of the bracket 325, while a screw 347 is inserted into the hole 337 of the bracket 325. The bracket 325 is positioned on the first end 332 of the support sleeve 330, with the screws 345, 347 being positioned within the cavity 336 of the support sleeve 330. The support sleeve 330 and bracket 325 (as assembled in the foregoing manner) are fitted within the aperture 320 of the paver 312, whereby the bracket 325 is positioned proximate to the exterior surface 316 of the paver 312. An optional O-ring (not shown) may be fitted around the exterior surface of the support sleeve 330 so as to promote centering of the support sleeve 330 within the aperture 320 of the paver 312.

Next, the plate 354 is positioned against the interior surface 318 of the paver 312. The screw 345 is inserted in the hole 341 of the plate 354, while the screw 347 is inserted within the hole 343 of the plate 354. A threaded locknut 349 is fastened to the screw 345, while a threaded locknut 351 is fastened to the screw 347. The locknuts 349, 351 are tightened against the second surface 358 of the plate 354, thereby securing the bracket 325 to the first end 332 of the support sleeve 330, as well as securing the support sleeve 330 within the aperture 320 of the paver 312.

It is noted that the bracket 325 and the support sleeve 330 are preferably two separate elements. Alternatively, the bracket 325 and the support sleeve 330 can be formed as a monolithic element, such that the first end 332 of the support sleeve 330 includes the features of the bracket 325, such as the locking tabs 329, 331.

It is further noted that the plate 356 acts as a stop to prevent the support sleeve 330 from being pressed into a bedding substrate (not shown in FIGS. 8 and 9) that the paver/light combination 310 is laid on, in the event that a force is applied directly on top of the light assembly 314. In turn, the light assembly 314 is prevented from traveling too far below the exterior surface 318 of the paver 312, thereby allowing the light assembly 314 to support vertical loading.

Next, the connector 326 is connected to the receptacle 346 of the socket 344, while the connector 328 is connected to the receptacle 348 of the socket 344. The ends 350, 352 of the wires 340, 342 are fed through the aperture 339 of the support plate 354. An end 353 of the wire 340 opposite the end 350 thereof and an end of the wire 355 opposite the end 352 thereof are each connected to an insulation piercing connector 357 (not shown in FIG. 9, but see FIG. 8). In turn, the insulation piercing connector 357 is connected to a power cable 359 which is connected to a power source (not shown in the Figures). The connector 357 prevents moisture or oxidation from entering into the contact area of the power cable 359. In addition, the insulation piercing connector 357 allows a user to remove the paver/light combination 310 from one location to another location along the power cable 359. Preferably, the insulation piercing connector 357 is positioned underneath a paver block that is adjacent to the paver/light combination 310 (not shown in the Figures) so as not to interfere with the other components of the paver/light combination 310. It is also noted that the power source has a preferable voltage of 12 volts, but it may have another voltage.

Next, the light assembly 314 is mounted to the bracket 325. More particularly, the tabs 321, 323 of the cam lock 317 are aligned between the locking tabs 329, 331 of the bracket 325 and the light assembly 314 is then twisted a one-quarter turn (i.e., 90 degrees) clockwise. As a result, the tabs 321, 323 of the cam lock of the light assembly 314 engage the locking tabs 329, 331 of the bracket 325, thereby securing the light assembly 314 to the bracket 325 and, in turn, to the support sleeve 330. The light assembly 314 can be easily and quickly removed for repair or replacement by twisting it one-quarter turn (i.e., 90 degrees) counter-clockwise. As a result, the tabs 321, 323 of the cam lock 317 disengage the locking tabs 329, 331 of the bracket 325, thereby facilitating the removal of the light assembly 314 from the bracket 325 and, in turn, from the support sleeve 330. The tabs 311, 313 of the lens cap 324 function as leverage points to facilitate the installation and removal of the light assembly 314 from the bracket 325 by a user with a special shaped key or another tool, such as a screwdriver. Although it is preferable that the lens cap 324 of the light assembly 314 include the tabs 311, 313, they are optional. Alternatively, the lens cap 324 may include other means for leverage to facilitate the removal of the light assembly 314 from the bracket 325, such as, for instance, recesses formed therein (not shown in the Figures).

It is noted that the paver 312 preferably has a rectangular-brick shape, but it can consist of other shapes and sizes. The plate 354 is preferably square in shape, but each can consist of other shapes and sizes. While the aperture 320 of the paver 312, the cavity 336 of the support sleeve 330, and the aperture 335 and the holes 337, 339 of the plate 354 are each preferably circular in shape, it should be noted that each can consist of other shapes and sizes. In addition, the lens cap 324 and the bracket 325 are each preferably disc-shaped, but each can consist of other shapes and sizes. Finally, the support sleeve 330 is preferably tubular in shape, but it can consist of other shapes and sizes.

Although the paver 312 is preferably manufactured from a masonry material, such as poured concrete or fired clay type building brick, it can be manufactured from other materials. In addition, the lens cap 324 of the light assembly 314 is preferably made from high impact polycarbonate, such as LEXAN® brand polycarbonate. Alternatively, the lens cap 324 can be made from other materials. The mounting bracket 325, the screws 345, 347 and the locknuts 349, 351 are each preferably made from stainless steel, but each can be made from other materials. The support plate 354 is preferably manufactured from a thin flexible corrosion resistant material, such as galvanized steel, or from aluminum. Alternatively, the support plate 354 can be manufactured from other materials. Finally, the support sleeve 330 is preferably manufactured from PVC pipe, but it can be manufactured from other materials.

A kit including the modular light assembly 314, the socket 344 and the bracket 325 may be obtained commercially from Truck-Lite Inc., of Falconer, N.Y., model number 10400.

Alternatively, the light assembly 314, the socket 344 and the bracket 325 can be supplied by other manufacturers and/or be characterized by other model and part numbers. In addition, the insulation piercing connector 357 may be obtained commercially from Hadco, Inc. of Littlestown, Pa., part number LVC3. Alternatively, the connector 357 can be supplied by other manufacturers and/or be characterized by other model and part numbers. Also, the wires 340, 342 can be SPT-1W wire, but they can consist of other types of wire.

Figure 11:
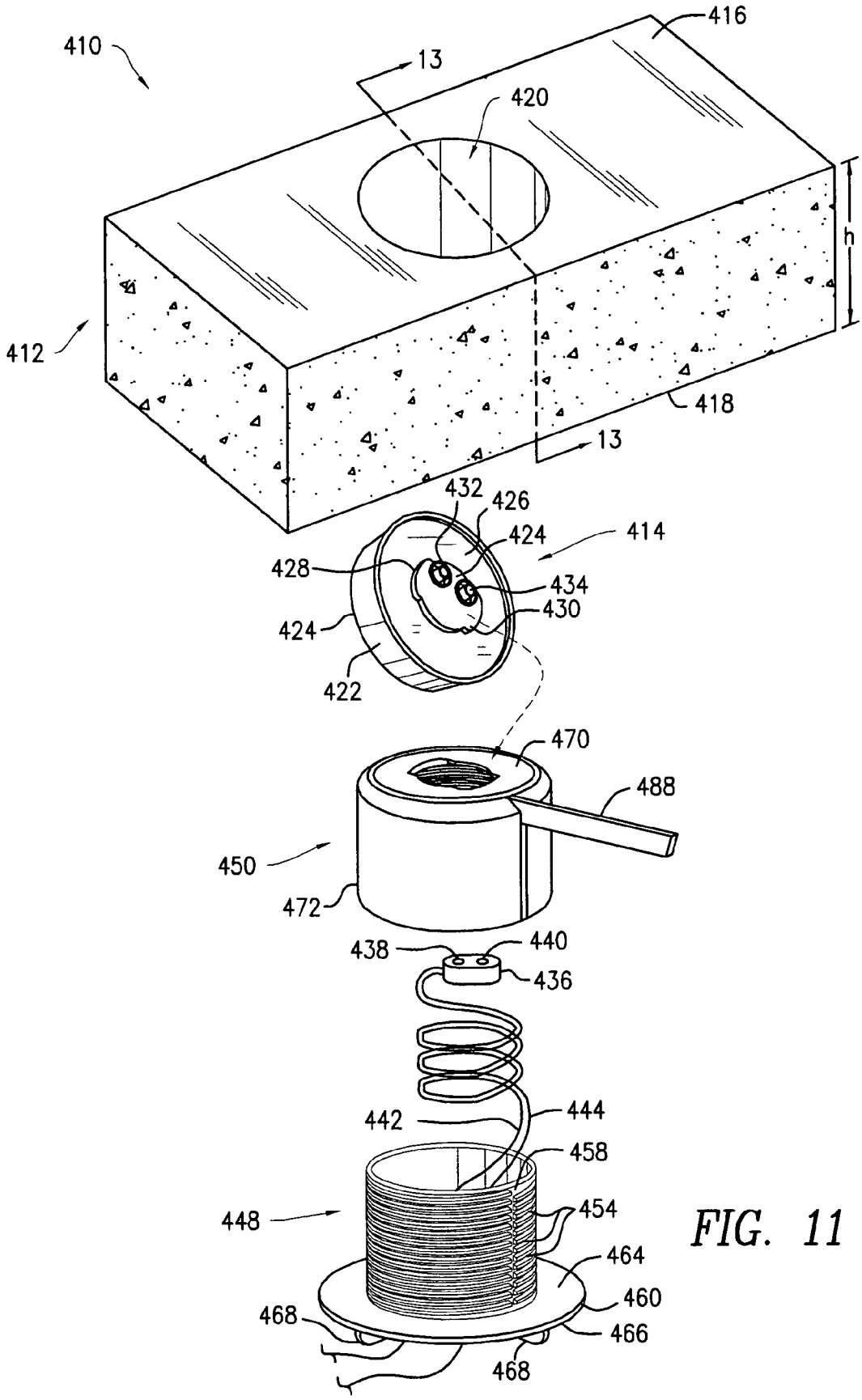
FIG. 11 is an exploded perspective view of a paver/light combination in accordance with still another exemplary embodiment of the present invention.
Figure 12:
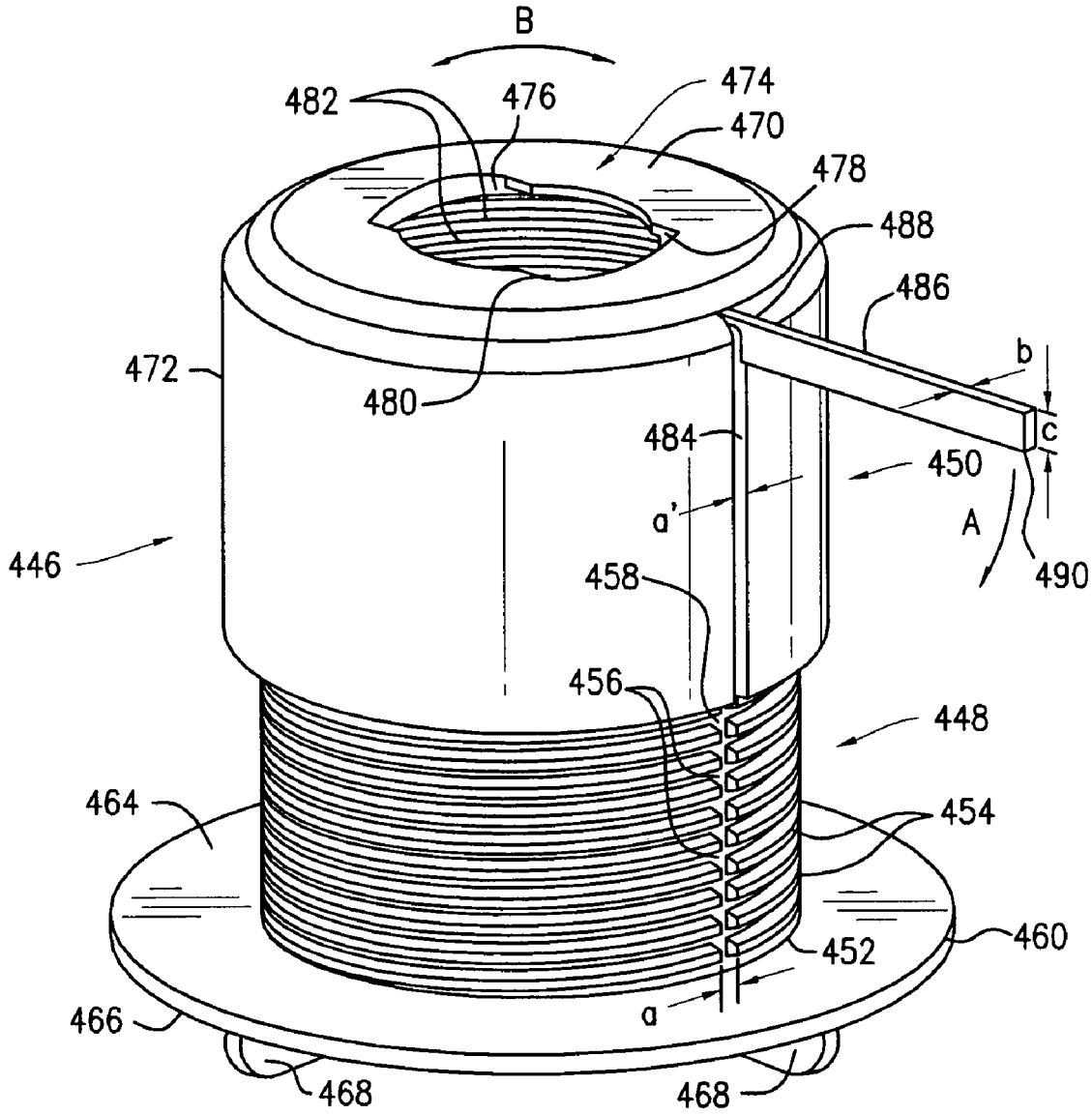
FIG. 12 is a perspective assembly view of a light support for the paver/light combination shown in FIG. 11, the paver and its associated light having been omitted to facilitate consideration and discussion.

FIGS. 11 and 12 illustrate a paver/light combination 410 which includes a rectangular-shaped paver 412 and a light assembly 414. The paver 412, which has a height h, includes an exterior surface 416 and an interior surface 418. A circular-shaped aperture 420 extends through the paver 412 from the exterior surface 416 to the interior surface 418. The aperture 420 is sized and shaped to receive the light assembly 414, as well as other components which will be described in more detail below.

The light assembly 414 includes a lens cap 422 and a cam lock 424 formed on a bottom surface 426 of the light assembly 414. The cam lock 424 has a pair of tabs 428, 430 whose function will be described hereinafter. A pair of plug-like connectors 432, 434 extend through and project from the cam lock 424. A socket 436, having receptacles 438, 440 that are sized, shaped and arranged to receive the connectors 432, 434, is connected to a pair of wires 442, 444 so as to connect the light assembly 414 to an electrical power source (not shown). The lens cap 422 of the light assembly 414 can be fabricated from a luminescent material, such as GE Lexan Polycarbonate, which is specifically formulated to glow in the dark. The paver 412, light assembly 414, and socket 436 are constructed and operate in a manner consistent with the construction and operation of the paver 312, light assembly 314, and socket 344 described above in association with FIGS. 8-10.

The paver/light combination 410 also includes a support 446, which adjustably supports the light assembly 414. The support 446 has a lower portion 448 and an upper portion 450, which is engageable with the lower portion 448 in a manner that is described in greater detail below. The support 446 can be fabricated from a corrosion-resistant material that is strong enough to withstand the forces that the paver/light combination 410 may be subjected to.

With particular reference now to FIG. 12, the lower portion 448 includes an outer surface 452 having a plurality of male threads 454. Grooves 456, each having a width a, extend through the threads 454 in vertical alignment so as to form a vertical channel 458 (FIG. 12 illustrates one of two diametrically opposed channels 458). The lower portion 448 also includes a flange 460 having a centrally located aperture 462 (see FIG. 13), which is sized and shaped to accommodate the wires 442, 444. The flange 460 also includes an upward facing surface 464, a downward facing surface 466, and a plurality of fins 468 positioned on the surface 466 so as to stabilize the support 446 when the surface 466 is in contact with a bedding substrate (not shown).

Still referring to FIG. 12, the upper portion 450 includes a top surface 470 and a cylindrical shell 472. The top surface 470 includes a circular aperture 474 and a pair of diametrically opposed locking tabs 476, 478. The locking tabs 476, 478 are constructed and operate in a manner consistent with the construction and operation of the corresponding elements described above and depicted in FIGS. 8-10. That is, the locking tabs 476, 478 cooperatively engage the tabs 428, 430 of the cam lock 424 in response to a twist-and-lock motion as described above in connection with FIGS. 8-10.

The shell 472 includes an inner surface 480, which is fabricated with a plurality of female threads 482. A vertically oriented slot 484, having a width a', is formed in the shell 472. A pin 486, having a width b and a depth c, is pivotally attached at an end 488 thereof to the upper portion 450, whereby an opposite end 490 of the pin 486 is free to rotate in the direction of arrow A. The width b of the pin 486 is slightly smaller than the widths a and a', while the length of the pin 486 (i.e., the distance between the ends 488 and 490) and its depth c are selected such that the pin 486 may be simultaneously inserted in the slot 484 and an aligned portion of one of the channels 458 when the pin 486 is fully rotated in the direction of arrow A. The purpose and positioning of the pin 488 will be described in greater detail below.

Figure 13:
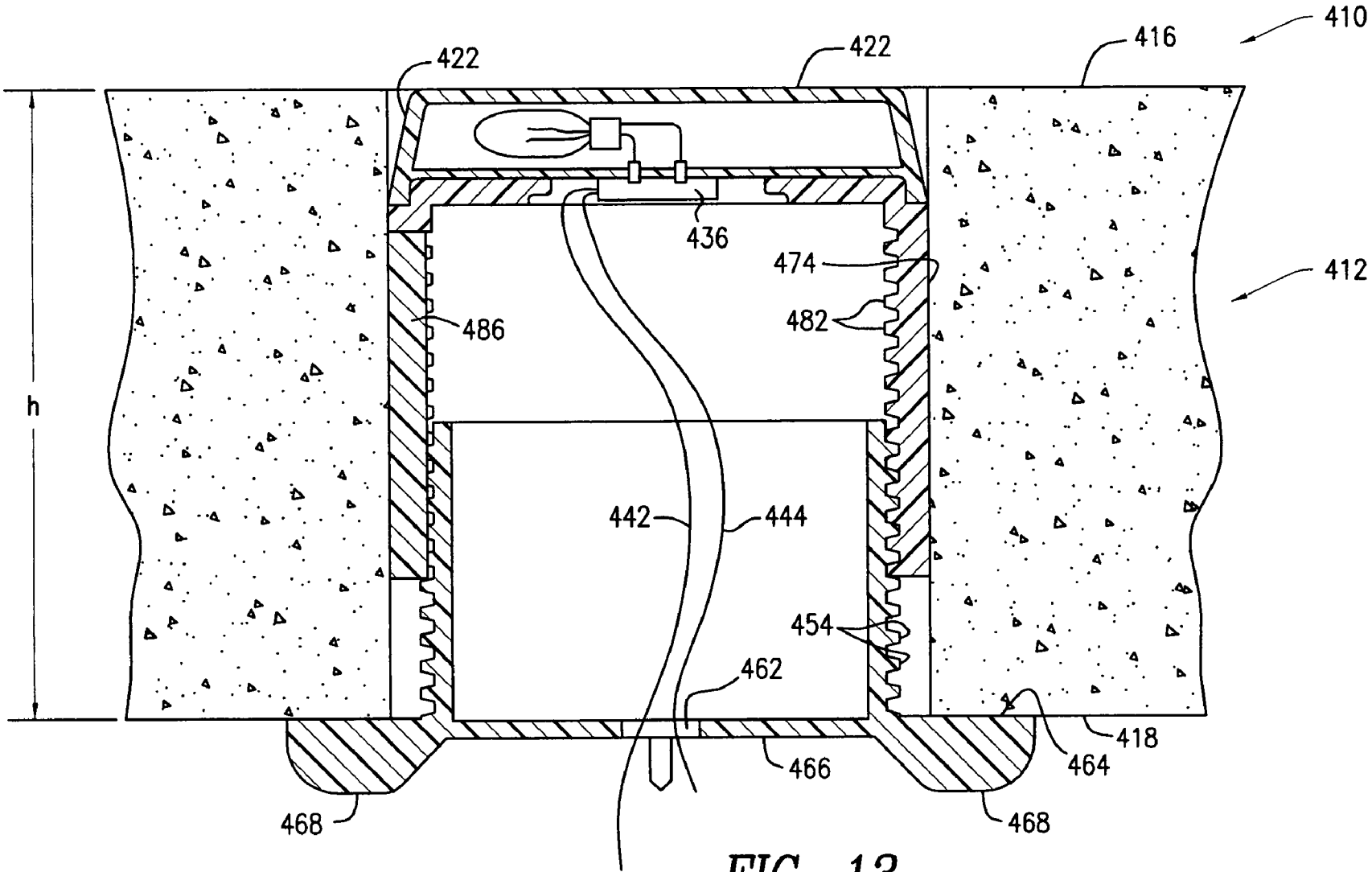
FIG. 13 is a cross-sectional view, taken along section line 13-13 and looking in the direction of the arrows, of the paver/light combination shown in FIG. 11.

Referring to FIGS. 12 and 13, some of the female threads 482 are depicted threadedly engaged with some of the male threads 454 of the lower portion 448. With the pin 486 fully rotated in a direction opposite of arrow A (i.e., rotated to the position illustrated in FIG. 12), the upper portion 450 is free to rotate, in the direction of arrow B, relative to the lower portion 448, whereby the distance between the upper facing surface 464 of the flange 460 and the top surface 470 of the upper portion 450 of the support 446 can be increased or decreased to an extent dependent upon the pitch of the threads 454, 482 and the direction of rotation.

In assembling the paver/light combination 410, the assembler first measures the height h of the paver 412 (see FIG. 11). The upper portion 450 of the support 446 is then threadedly engaged with the lower portion 448 of the support 446, and the light assembly 414 is affixed to the top surface 470 of the upper portion 450 with a twist-and-lock motion as described above. The upper portion 450 is then rotated relative to the lower portion 448, in order to set the distance between the top surface 470 of the upper portion 450 and the upper facing surface 464 of flange 460 substantially equal to the height h. At this point, the upper portion 450 is carefully rotated until one of the two channels 458 of the lower portion 448 is completely visible in the slot 486 of the upper portion 450. The pin 486 is then rotated in the direction of the arrow A until it is simultaneously positioned within the channel 458 and the slot 484 (see FIG. 13), thereby interlocking the upper and lower portions 450, 448 with each other.

The assembled support 446 and its associated light assembly 414 are then uncoupled, with a twist-and-unlock motion that is the reverse of the twist-and-lock motion as described above. The socket 436 and associated wires 442, 444 are then extended through the aperture 462, while the connectors 432, 434 of the light assembly 414 are inserted into the receptacles 438, 440 of the socket 436. The light assembly 414 is then once again coupled to the support 446, and the assembled support 446 and its associated light assembly 414 are inserted into the aperture 420, from the bottom of the paver 412, such that the lens cap 422 is substantially level (i.e., flush) with the exterior surface 416 of the paver 412. The paver/light combination 410 may now be installed onto a bedding substrate (not shown), wherein the downward facing surface 466 of the flange 460 and the fins 468 cooperate to prevent the assembled support 446 and its associated light assembly 414 from rotating or becoming substantially separated from the paver 412 (i.e., when a disturbing rotational and/or downward force is applied to the lens cap 422 of the light assembly 414, for example by a wheel of a vehicle).

Figure 14:
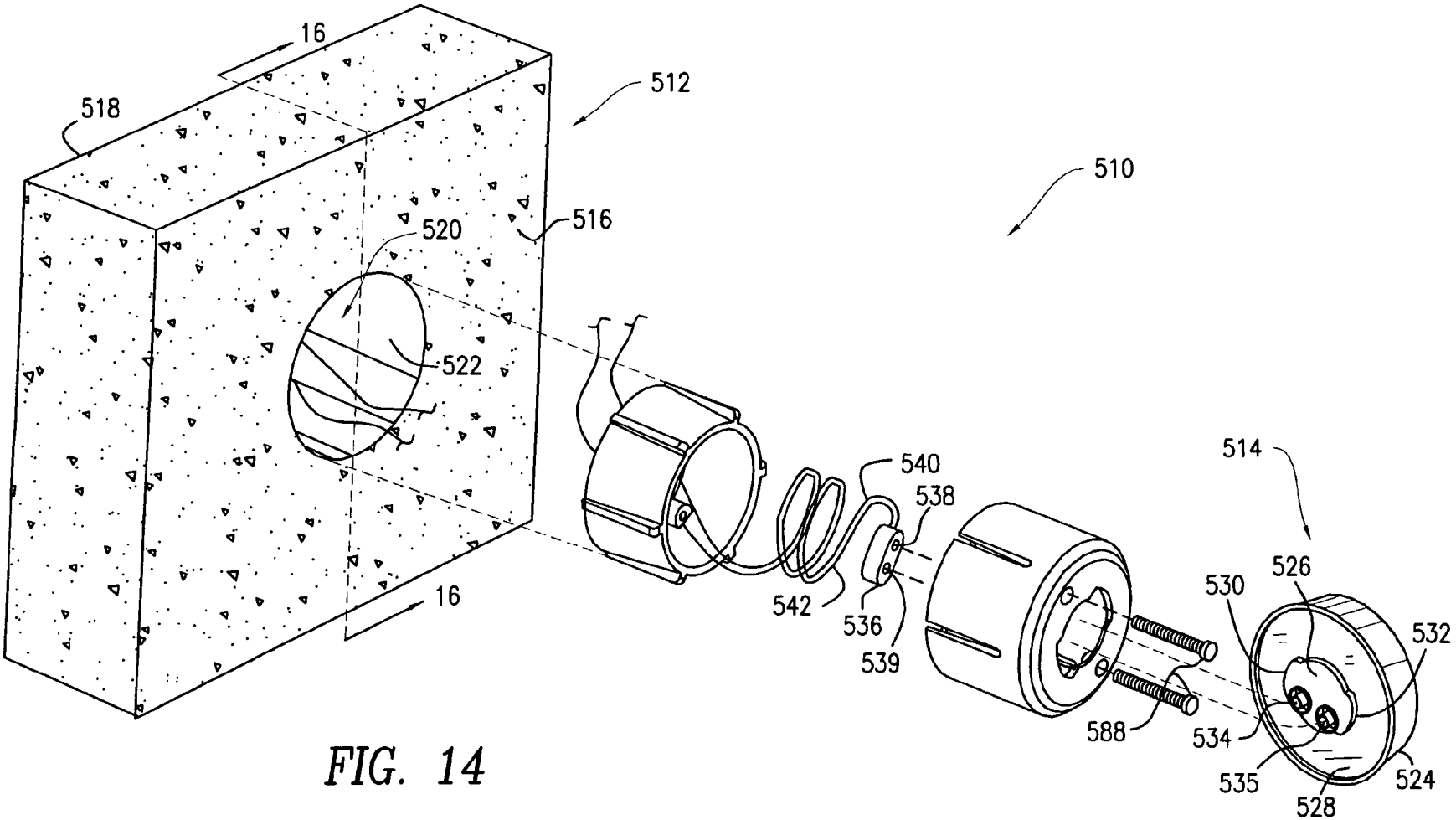
FIG. 14 is an exploded perspective view of a block/light combination in accordance with a still further exemplary embodiment of the present invention.
Figure 15:
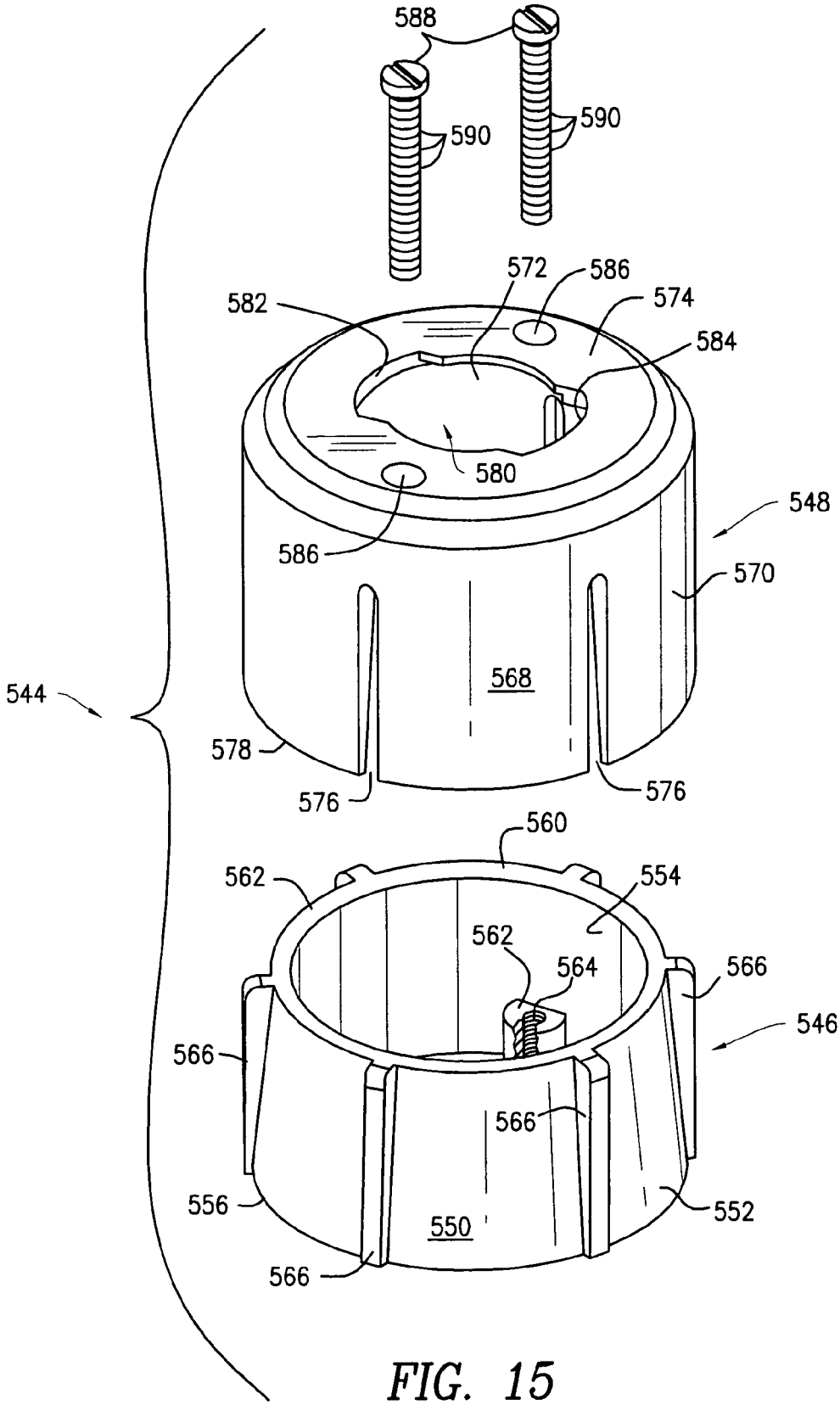
FIG. 15 is an exploded perspective view of a light support for the block/light combination shown in FIG. 14, the block and its associated light having been omitted to facilitate consideration and discussion.
Figure 16:
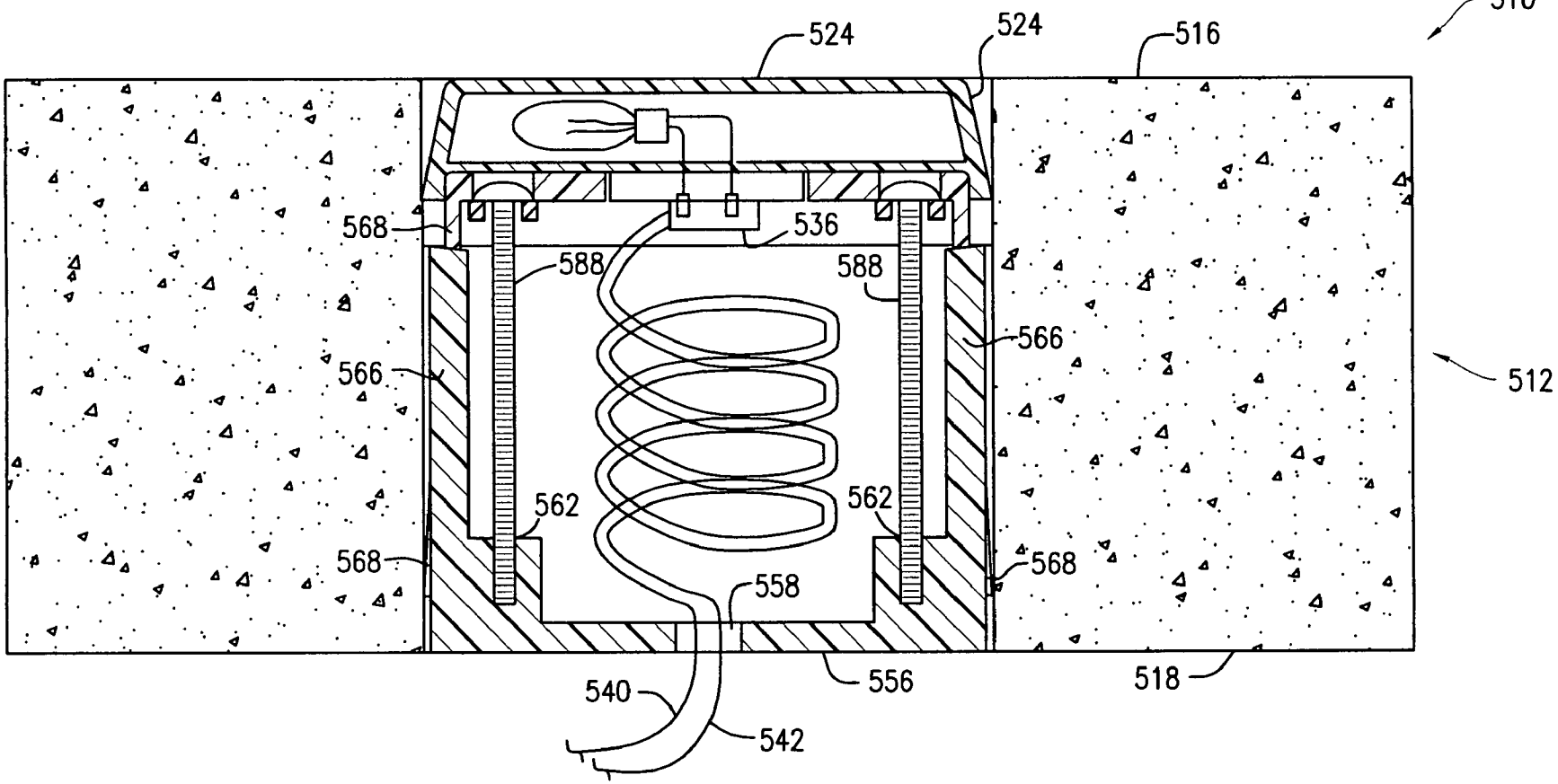
FIG. 16 is a cross-sectional view, taken along section line 16-16 and looking in the direction of the arrows, of the block/light combination shown in FIG. 14.

FIGS. 14-16 illustrate a block/light combination 510 which includes a square-shaped block 512 and a light assembly 514. The block 512 has an exterior surface 516, an interior surface 518, and an aperture 520 which extends through the block 512 from the exterior surface 516 to the interior surface 518. The aperture 520, which has a cylindrical inner surface 522, is sized and shaped so that the light assembly 514, as well as other components of the block/light combination 516, can be accommodated within the block 512.

The light assembly 514 includes a lens cap 524 and cam lock 526 formed on a bottom surface 528 of the light assembly 514. The cam lock 526 has a pair of tabs 530, 532 whose function will be described hereinafter. A pair of plug-like connectors 534, 535 extend through and project from the cam lock 526. A socket 536, having receptacles 538, 539 that are sized, shaped and arranged to receive the connectors 534, 535, is connected to a pair of wires 540, 542, so as to connect the light assembly 514 to an electrical power source (not shown). The lens cap 524 of the light assembly 514 can be fabricated from a luminescent material such as GE Lexan Polycarbonate, which is specifically formulated to glow in the dark. The block 512, the light assembly 514, and the socket 536 are constructed and operate in a manner consistent with the construction and operation of the paver 312, the light assembly 314, and the socket 344 described above and depicted in FIGS. 8-10.

The block/light combination 510 also includes a support 544, which supports the light assembly 514. The support 544 has inner and outer portions 546, 548 that are engageable with each other in a manner that is described in greater detail below. The inner and outer portions 546, 548 of the support 544 can be fabricated from a corrosion resistant material that is strong enough to withstand the forces that the block 510 may be subjected to.

The inner portion 546 includes a shell 550 having outer and inner surfaces 552, 554, and a bottom 556 having a centrally located aperture 558 (see FIG. 16). The shell 550 also includes a ring-shaped surface 560, which is located opposite the bottom 556. The diameter of the outer surface 552 of the shell 550 progressively decreases when measured from the bottom 556 to the surface 560. The inner surface 554 also includes a pair of diametrically opposed receptacles 562, each having internal female threads 564 for use in attaching the inner portion 546 to the outer portion 548 in a manner which will be described in greater detail hereinafter. The outer surface 552 of the shell 550 includes a plurality of ridges 566 spaced apart about the periphery of the shell 550 for a purpose which will be described in greater detail hereinafter.

With particular reference to FIGS. 14 and 15, the outer portion 548 includes an outer shell 568 having outer and inner surfaces 570, 572, and an end surface 574. The outer shell 568 has a plurality of slots 576, each one being sized, shaped, and arranged to receive one of the ridges 566 of the inner portion 546. When the ridges 566 are inserted into the slots 576, the inner portion 546 is free to move, relative to the outer portion 548, in a longitudinal direction without substantial rotation between the inner and outer portions 546, 548. The outer portion 548 also includes a bottom ring-shaped surface 578, which is located opposite the end surface 574. The end surface 574 includes a aperture 580 and a pair of diametrically opposed locking tabs 582, 584. The locking tabs 582, 584 are constructed and operate in a manner consistent with the construction and operation of the corresponding elements described above and depicted in FIGS. 8-10. That is, the locking tabs 582, 584 cooperatively engage the tabs 530, 532 of the cam lock 526 in response to a twist-and-lock motion as described above in connection with FIGS. 8-10. It should be noted that the diameter of the inner surface 572 of the outer shell 568 progressively decreases when measured from the ring-shaped surface 578 to the end surface 574. This design enables the outer surface 552 of the inner portion 546 to exert radially-acting wedging forces on the inner surface 572 of the outer portion 548, when the inner portion 546 is inserted into the outer portion 548. The wedging action will be described in greater detail hereinafter.

Now referring to FIGS. 15 and 16, a pair of diametrically opposed orifices 586 is positioned on the end surface 574 of the outer portion 548 of the support 544. A pair of bolts 588, each of which includes male threads 590, extend through the orifices 586 so as to threadedly engage the female threads 564 of the receptacles 562, thereby fastening the inner portion 546 to the outer portion 548.

In assembling the block/light combination 510, the connectors 534, 535 of the light assembly 514 are first inserted into the receptacles 538, 539 of the socket 536. The light assembly 514 is then attached to the end surface 574 of the outer portion 548 of the support 544, in a twist-and-lock motion as described above in association with FIGS. 8-10. The inner and outer portions 546, 548 of the support 544 are then engaged with each other by inserting the ridges 566 of the inner portion 546 into the slots 576 of the outer portion 548. The bolts 588 are then extended through the orifices 586 of the outer portion 548 of the support 544 such that the external threads 590 of the bolts 588 are aligned and in contact with the internal threads 564 of the receptacles 562 of the inner portion. The bolts 588 are then rotated with a screwdriver so as to threadedly engage the internal threads 565 of the receptacles 564. The resulting assembly (i.e., the support 544 combined with the light assembly 514) is then inserted into the aperture 520 from the bottom of the block 512, such that the lens cap 524 is positioned substantially flush (i.e., level) with the exterior surface 516 of the block 512 (as depicted in FIG. 16). The bolts 588 are then rotated with a screwdriver such that the outer surface 552 of the inner portion 546 of the support 544 wedges against, and exerts forces in the radial direction upon, the inner surface 572 of the outer portion 548. The slots 576 promote flexing of the outer portion 548 in response to the radial forces exerted by the outer surface 552 of the inner portion 546. The bolts 588 are rotated in this manner until the outer surface 570 of the outer shell 568 firmly contacts the inner surface 522 of the block 512, such that the support 544 and light assembly 514 combination is fixedly positioned in the block 512.

Figure 17:
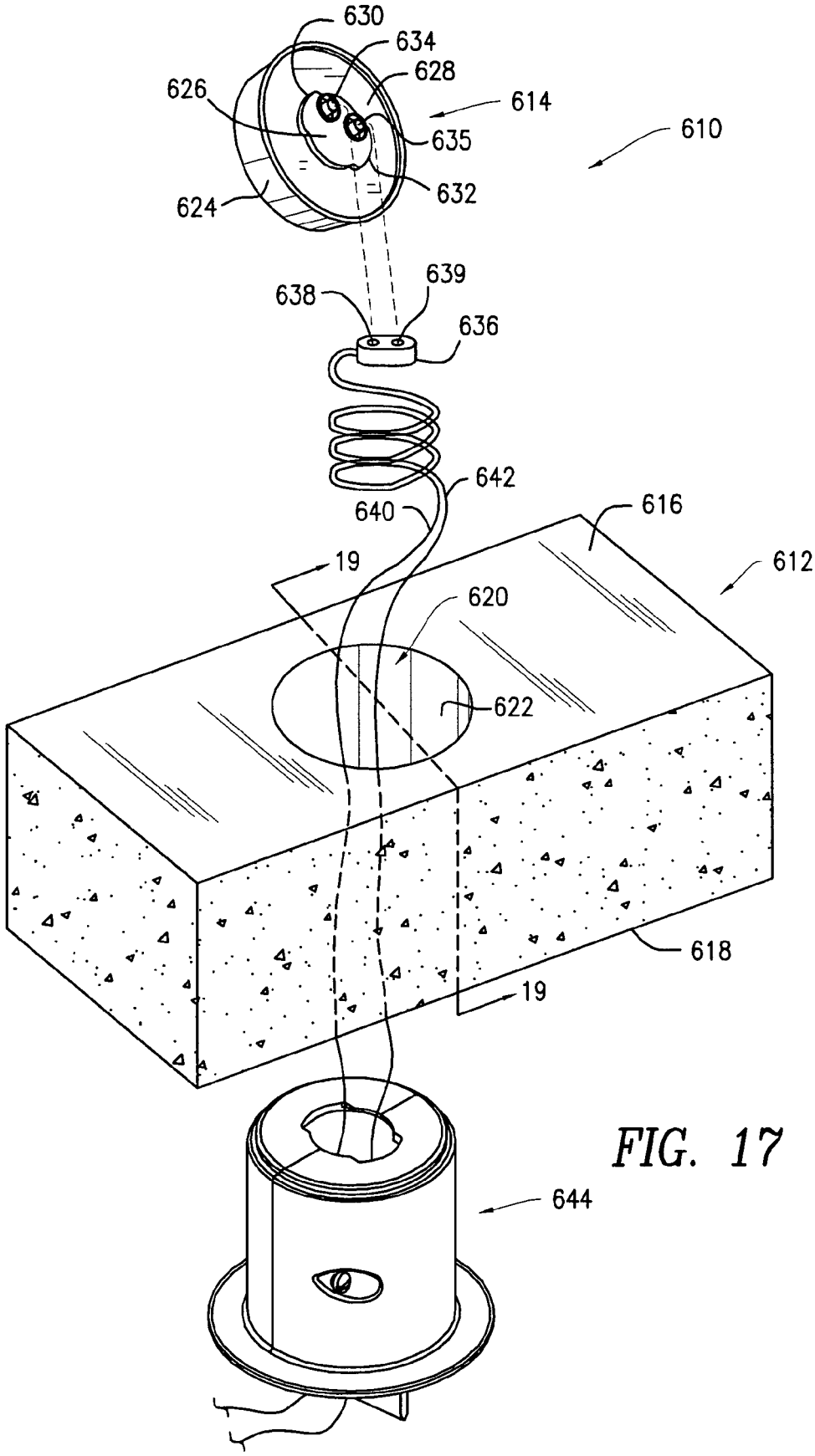
FIG. 17 is an exploded perspective view of a paver/light combination in accordance with another exemplary embodiment of the present invention.
Figure 18:
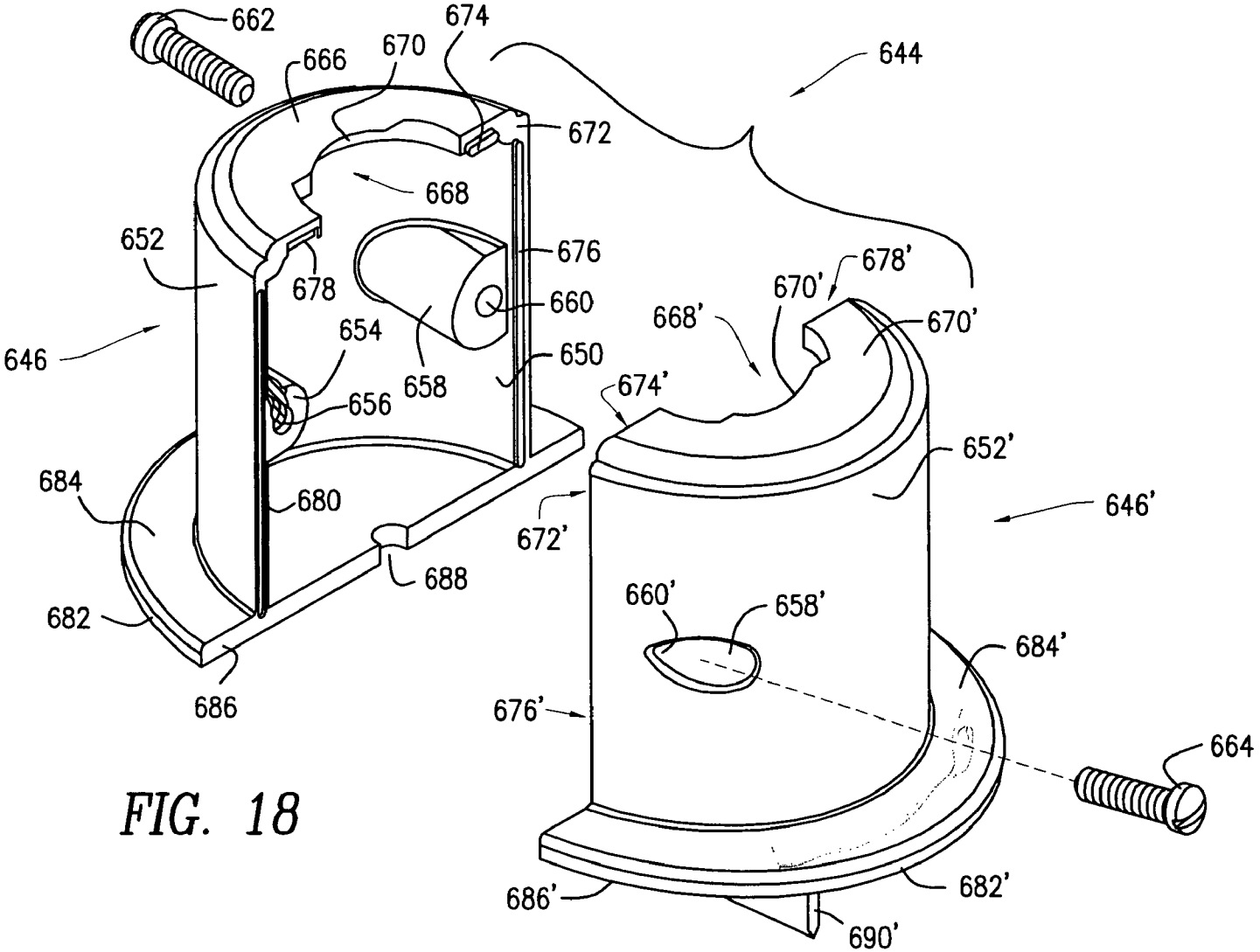
FIG. 18 is an exploded perspective view of a light support for the paver/light combination shown in FIG. 17, the paver and its associated light having been omitted to facilitate consideration and discussion.
Figure 19:
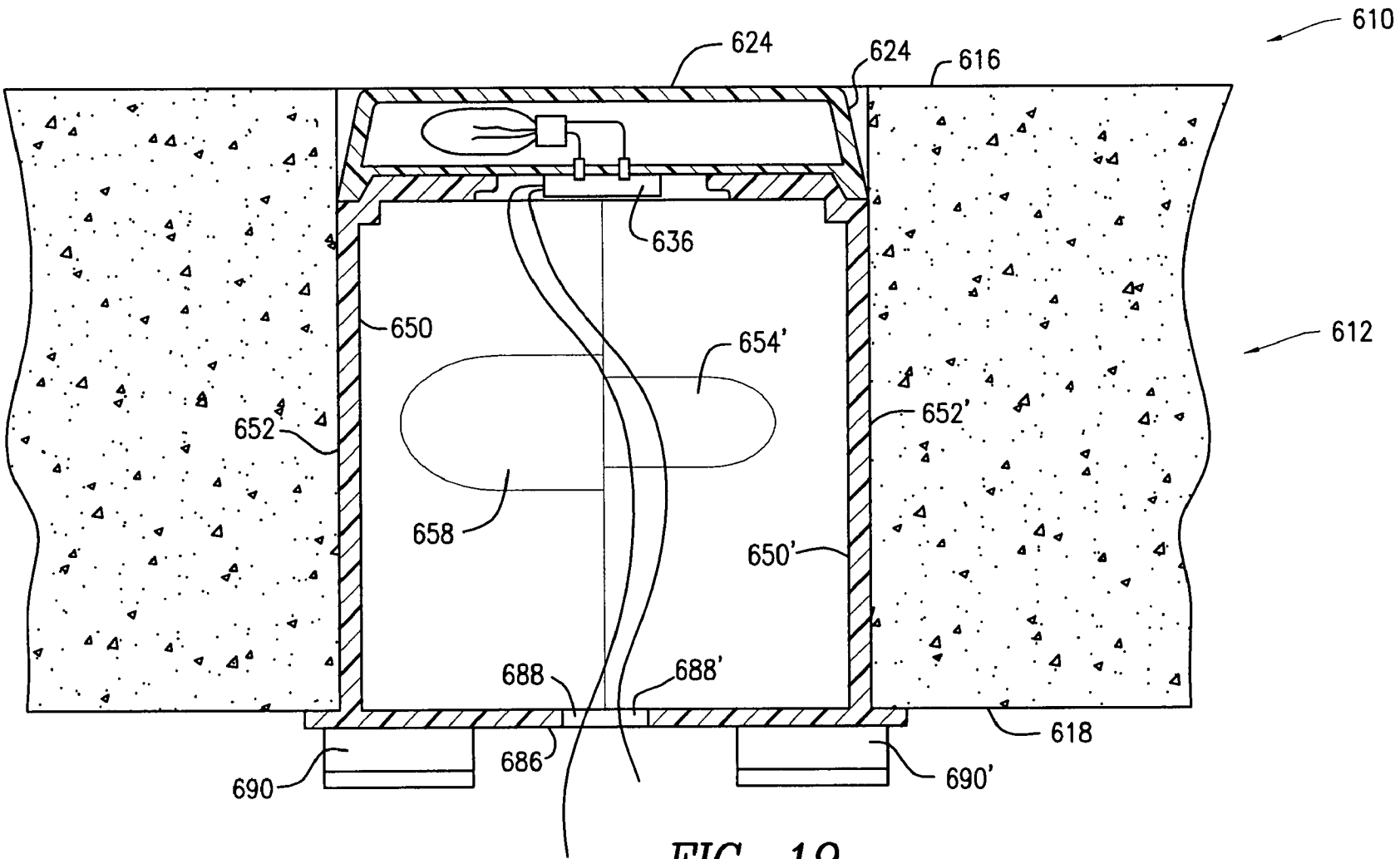
FIG. 19 is a cross-sectional view, taken along section line 19-19 and looking in the direction of the arrows, of the paver/light combination shown in FIG. 17.

FIGS. 17-19 illustrate a paver/light combination 610 which includes a paver 612 and a light assembly 614. The paver 612 includes an exterior surface 616 and an interior surface 618. A circular-shaped aperture 620, having a cylindrical inner surface 622, extends through the paver 612 from the exterior surface 616 to the interior surface 618. The aperture 620 is sized and shaped so that the light assembly 614, as well as other components of paver/light combination 610, can be accommodated within paver 612.

The light assembly 614 includes a lens cap 624 and a cam lock 626 formed on a bottom surface 628 of the light assembly 614. The cam lock 626 has a pair of tabs 630, 632 whose function will be described hereinafter. A pair of plug-like connectors 634, 635 extend through and project from the cam lock 626. A socket 636, having receptacles 638, 639 that are sized, shaped and arranged to receive the connectors 634, 635, is connected to a pair of wires 640, 642 so as to connect the light assembly 614 to an electrical power source (not shown). The lens cap 624 of the light assembly 614 can be fabricated from a luminescent material such as GE Lexan Polycarbonate, which is specifically formulated to glow in the dark. The paver 612, the light assembly 614, and the socket 636 are constructed and operate in manners consistent with the construction and operation of the paver 312, the light assembly 314, and the socket 344 described above and depicted in FIGS. 8-10.

The paver/light combination 610 also includes a support 644 which supports the light assembly 614. The support 644 is made from two identical twin portions 646, 646', which are sized and shaped to form the support 644 when they are joined together (see FIG. 17). The twin portions 646, 646' can be fabricated from a corrosion resistant material which is strong enough to withstand the forces that the paver 610 may be subjected to. The features and construction of the twin portions 646, 646' of the support 644 are described in greater detail below.

Referring to now to FIGS. 18-19 and focusing on the twin portion 646, it includes inner and outer surfaces 650, 652. The inner surface 650 is provided with a threaded receptacle 654, having an internally threaded blind bore 656, and an unthreaded receptacle 658, having an unthreaded through hole 660. The receptacle 654, 658 are adapted to receive a pair of threaded bolts 662, 664 in a manner to be described in greater detail hereinbelow.

The twin portion 646 further includes a top 666 which has a semi-circular recess 668 and a locking tab 670 formed therein. The twin portion also includes an edge 672 which has positioning lugs 674, 676 and complementary shaped recesses 678, 680 formed therein. The functions and the interaction of these elements, with similar elements on the twin portion 646' will be described hereinafter.

Additionally, the twin portion 646 includes a semicircular flange 682, having upward and downward facing surfaces 684, 686. A semicircular recess 688 is located centrally in the flange 682. The flange 682 also has at least one fin 690 (see FIG. 19) depending from the downward facing surface 686, for stabilizing the twin portion 646 and hence the support 644 when the support 644 is installed in a bedding substrate (not shown).

Focusing now on the twin portion 646', it is identical to the twin portion 646, and the twin portions are hermaphroditic. For purposes of brevity, the reference numerals designating the elements of the twin portion 646' are the same as the reference numerals designating the corresponding elements of the twin portion 646 except that they are followed by a prime superscript. The elements of the twin portions 646' are depicted in FIGS. 17-18, and are described below using the aforementioned reference numeral protocol.

In assembling the paver/light combination 610, the support 644 is first formed by joining the first and second portions 646, 646' together. More particularly, the lugs 674, 676 of the twin portion 646 are positioned into the corresponding recesses 678', 680' (neither of which is visible in the figures)of the twin portion 646', and vice versa. Likewise the bolts 662, 664 are positioned inserted the holes 660, 660', respectively, and threadedly engaged with the receptacles 654, 654', respectively, such that the edges 672, 672' are flush with each other.

The light assembly 614 is then attached to the support 644. More particularly, the locking tabs 670, 670' of the support 644 cooperatively engage the tabs 630, 632 of the cam lock 626, in response to a twist-and-lock motion as described and depicted in FIGS. 8-10. The light assembly 614 and associated support 644 are then inserted into the aperture 620, from the bottom of the paver 612, until the upper facing surfaces 684, 684' of flanges 682, 682' are substantially flush with the interior surface 618 of the paver 612, and the lens cap 624 is substantially level (i.e., flush) with the exterior surface 616 of the paver 612. The paver/light combination 610 may then be installed onto a bedding substrate (not shown) wherein the downward facing surfaces 686 of the flanges 682 and fins 690 cooperate to prevent the assembled support 644 and its associated light assembly 614 from rotating relative to, or becoming substantially separated from, the paver 612 (i.e., when a disturbing rotational and/or downward force is applied to the lens cap 624 of the light assembly 614, for example by a wheel of a vehicle).

Figure 20:
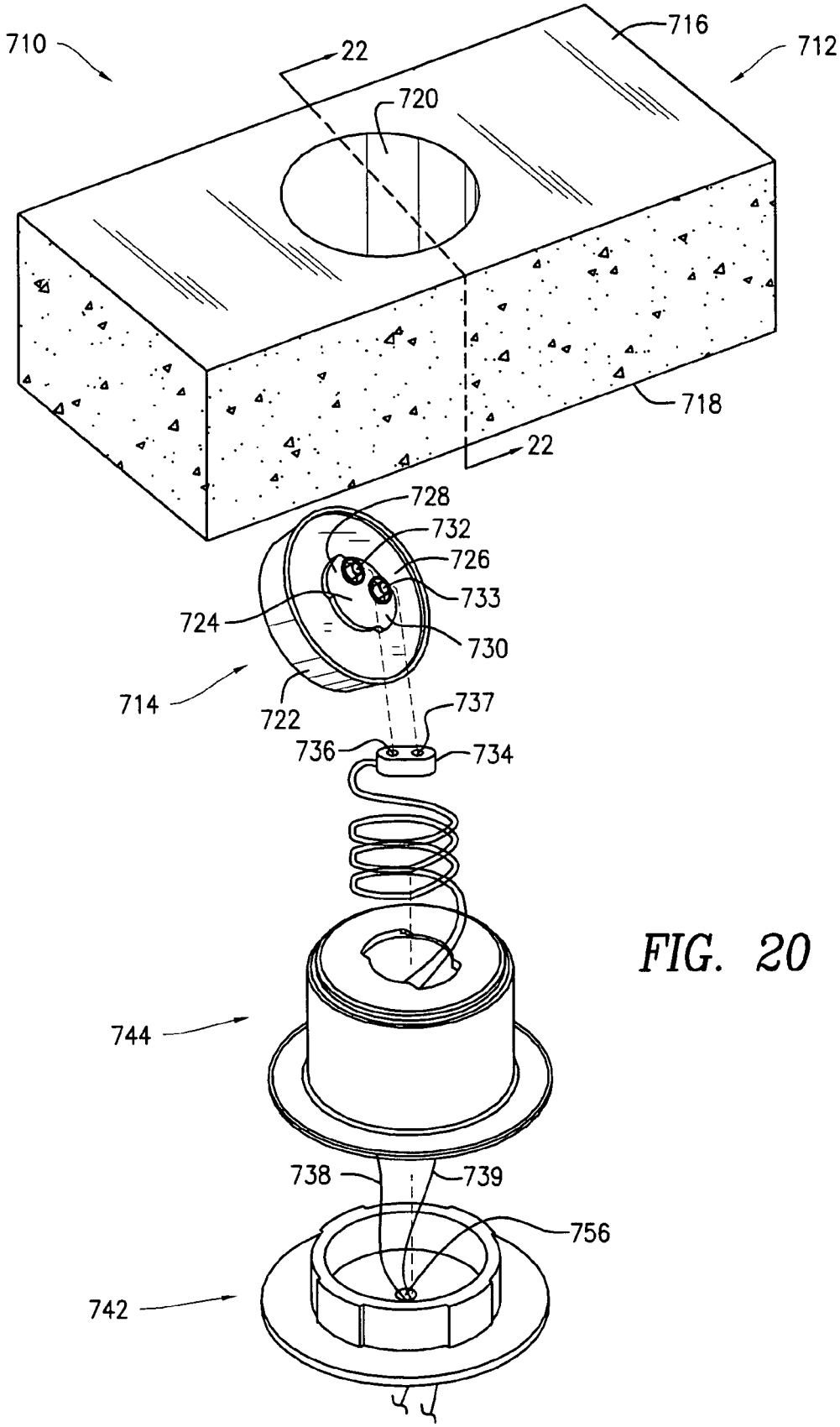
FIG. 20 is an exploded perspective view of a paver/light combination in accordance with another exemplary embodiment of the present invention.
Figure 21:
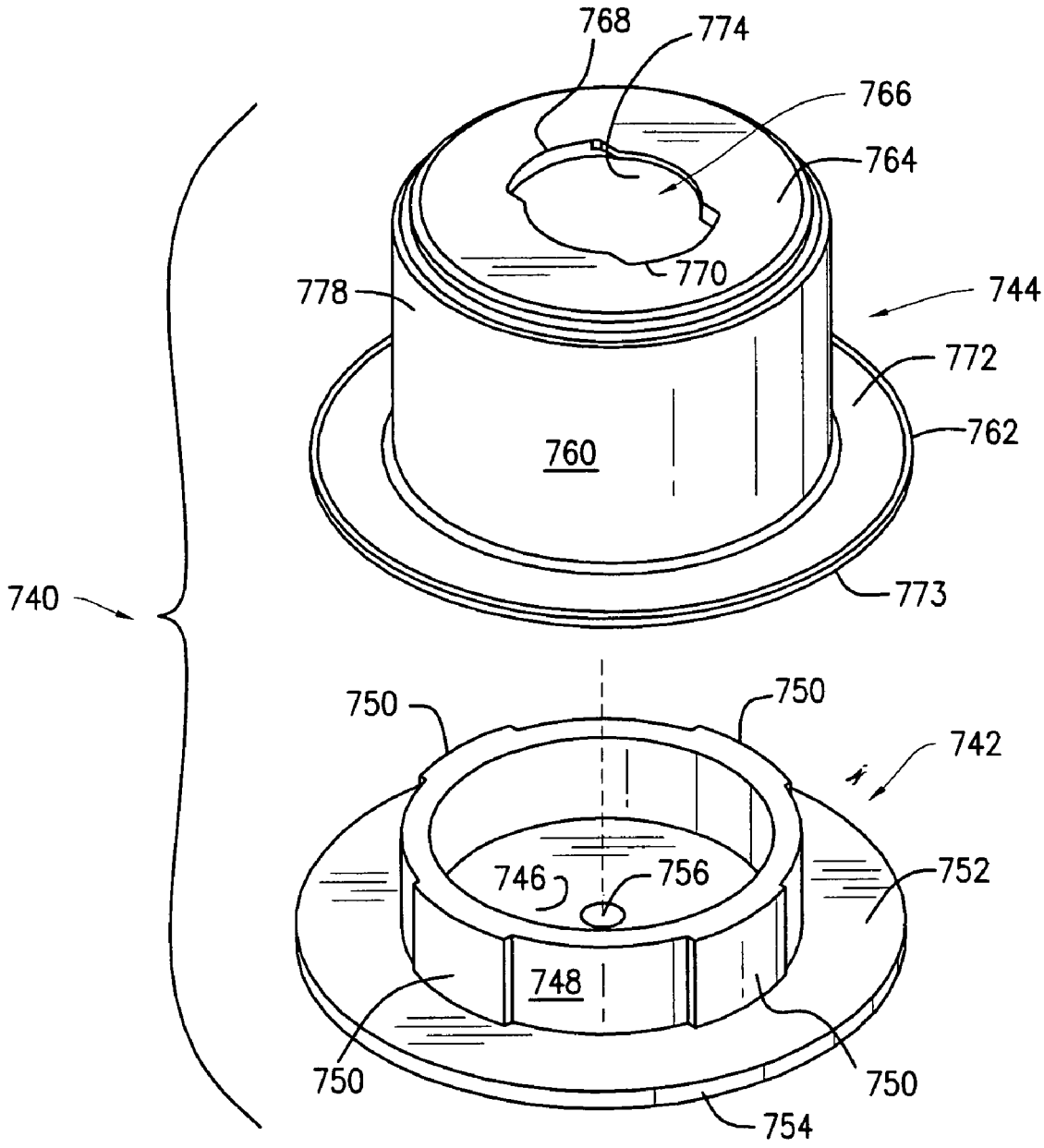
FIG. 21 is an exploded perspective view of a light support for the paver/light combination shown in FIG. 20, the paver and its associated light having been omitted to facilitate consideration and discussion.
Figure 22:
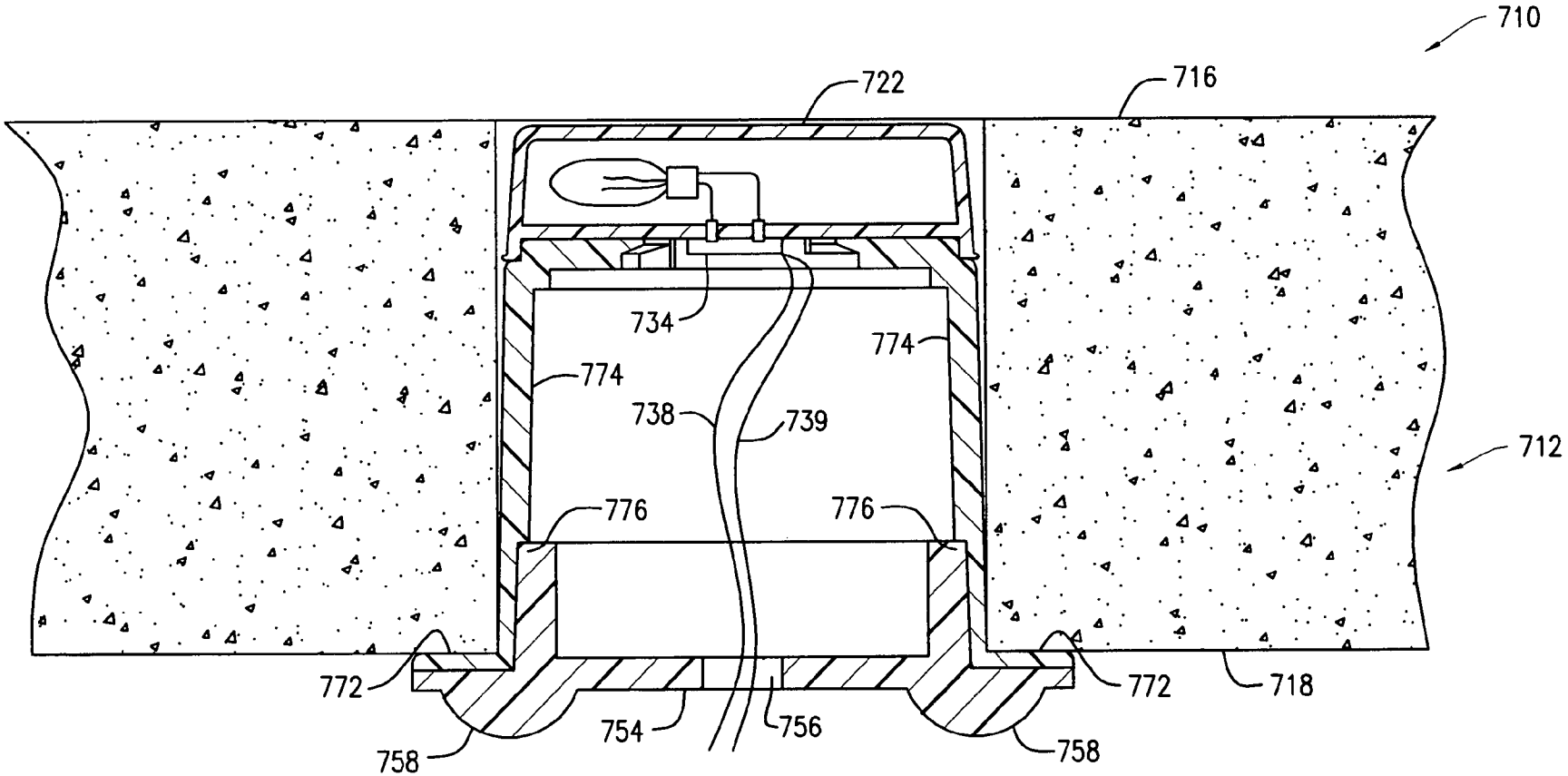
FIG. 22 is a cross-sectional view, taken along section line 22-22 and looking in the direction of the arrows, of the paver/light combination shown in FIG. 20.

FIGS. 20-22 illustrate a paver/light combination 710 which includes a paver 712 and a light assembly 714. The paver 712 includes an exterior surface 716 and an interior surface 718. A circular-shaped aperture 720 extends through the paver 712 from the exterior surface 716 to the interior surface 718. The aperture 720 is sized and shaped so that the light assembly 714, as well as other components of paver/light assembly 710, can be accommodated within paver 712.

The light assembly 714 includes a lens cap 722 and a cam lock 724 formed on a bottom surface 726 of the light assembly 714. The cam lock 724 has a pair of tabs 728, 730 whose function will be described hereinafter. A pair of plug-like connectors 732, 733 extend through and project from the cam lock 724. A socket 734, having receptacles 736, 737 that are sized, shaped and arranged to receive the connectors 732, 733, is connected to a pair of wires 738, 739 so as to connect the light assembly 714 to an electrical power source (not shown). The lens cap 722 of the light assembly 714 can be fabricated from a luminescent material such as GE Lexan Polycarbonate, which is specifically formulated to glow in the dark. The paver 712, the light assembly 714, and the socket 734 are constructed and operate in manners consistent with the construction and operation of the paver 312, the light assembly 314, and the socket 344 described above and depicted in FIGS. 8-10.

The paver/light combination 710 also includes a support 740 which supports the light assembly 714. The support 740 has lower and upper portions 742, 744 that are engageable with each other so as to form the support 740. The lower and upper portions 742, 744 of the support 740 can be fabricated from a corrosion-resistant material that is strong enough to withstand the forces that the paver/light combination 710 may be subjected to. The features and construction of the lower and upper portions 742, 744 are described in greater detail below.

The lower portion 742 includes a circular base 746 and a cylindrical body 748, having a plurality of splines 750 on an outer surface 752 of the body 748. The base 746 includes a flange 754, a centrally located orifice 756 and a plurality of fins 758 (see FIG. 22) depending from the flange 754 for stabilizing the lower portion 742 and hence the support 740 when the support 740 is installed in a bedding substrate (not shown).

The upper portion 744 includes a cylindrical shell 760, a flange 762, and a top surface 764. The top surface 764 includes a circular aperture 766 and a pair of diametrically opposed locking tabs 768, 770. The locking tabs 768, 770 are constructed and operate in a manner consistent with the construction and operation of the corresponding elements described above and depicted in FIGS. 8-10. That is, the locking tabs 768, 770 cooperatively engage the tabs 728, 730 of the cam lock 724 in response to a twist-and-lock motion as described above in connection with FIGS. 8-10. The flange 762 includes upper and lower surfaces 772, 773. The shell 760 also includes an inner surface 774 that has a plurality of vertical recesses 776 (see FIG. 21) formed therein, each one being adapted to receive a corresponding one of the splines 750 of the lower portion 742.

In assembling the paver/light combination 710, the support 740 is assembled by inserting the splines 750 of the lower portion 742 into the recesses 776 of the upper portion 744. The light assembly 714 is then attached to the support 740. More particularly, the locking tabs 768, 770 of the support 740 cooperatively engage the tabs 728, 730 of the cam lock 724, in response to a twist-and-lock motion as described and depicted in FIGS. 8-10.

Referring specifically to FIG. 22, the light assembly 714 and associated support 740 are then inserted into the aperture 720, from the bottom of the of the paver 712, such that the upper surface 772 of the upper flange 762 is flush with the interior surface 718 of the paver 712. The paver/light combination 710 may then be installed onto a bedding substrate (not shown) wherein the downward facing surface 754 and the fins 758 of the lower flange 750 of the lower portion 742 cooperate to prevent the support 740 and light assembly 714 combination from rotating or becoming substantially separated from the paver 712 (i.e., when a disturbing rotational and/or downward force is applied to the lens cap 722 of the light assembly 714, for example by a wheel of a vehicle).

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A lighting fixture for a masonry structure, comprising a support member having a first end, a second end opposite said first end, an internal cavity between said first and second ends, and a first locking member positioned at said first end, said support member including a first portion and a second portion releasably attached to said first portion, said support member further being sized and shaped for insertion within an aperture of the masonry structure such that said first end of said support member is proximate to an exterior surface of the masonry structure; first inhibiting means for inhibiting relative rotation between said first and second portions; an electrical socket removably received within said cavity of said support member; and a modular light assembly releasably connected to said socket, said modular light assembly including a light source and a second locking member rotatable relative to said first locking member and releasably engageable with said first locking member in response to the relative rotation of said first and second locking members, said modular light assembly being removably mounted to said first end of said support member by said first and second locking members, wherein said first inhibiting means includes a plurality of recesses on said first portion and a plurality of splines on said second portion, each spline being sized and shaped so as to be receivable in a corresponding one of said recesses.

2. The lighting fixture as claimed in claim 1, wherein said support member includes second inhibiting means for inhibiting said support member from exiting the aperture of the masonry structure at the exterior surface of the masonry structure.

3. The lighting fixture as claimed in claim 2, wherein said second inhibiting means includes a flange formed about a periphery of said second portion proximate said second end of said support member.

4. The lighting fixture as claimed in claim 3, wherein said support member includes third inhibiting means for inhibiting said support member from rotating relative to the masonry structure.

5. The lighting fixture as claimed in claim 4, wherein said third inhibiting means includes a plurality of pins depending from said second portion proximate said second end of said support member.

6. The lighting fixture as claimed in claim 1, further including first connecting means on said modular light assembly and second connecting means on said socket, said first and second connecting means being releasably engageable with each other so as to mechanically and electrically connect said modular light assembly to said socket.

7. The lighting fixture as claimed in claim 6, wherein said first connecting means of said modular light assembly includes at least one connector, and said second connecting means of said socket includes at least one receptacle.

8. The lighting fixture as claimed in claim 7, wherein said socket is removable from said cavity of said support member in response to the removal of said modular light assembly from said first end of said support member, whereby, after removing said modular light assembly from said first end of said support member, said modular light assembly can be disconnected from said socket externally of the masonry structure for the purposes of repair or replacement.

9. The lighting fixture as claimed in claim 8, further comprising at least one electrical wire having a first end and a second end opposite thereof, said first end of said wire being electrically connected to said socket and said second end of said wire being electrically connected to an external power source, said wire having a predetermined length to allow said socket to be removed from said cavity of said support member as said modular light assembly is removed from said first end of said support member.

10. The lighting fixture as claimed in claim 1, wherein said modular light assembly includes shielding means for shielding said light source of said modular light assembly from external objects.

11. The lighting fixture as claimed in claim 10, wherein said shielding means includes a lens cap.

12. The lighting fixture as claimed in claim 11, wherein said lens cap is made from a luminescent material.

* * * * *